US008063876B2

(12) United States Patent
Jang et al.

(10) Patent No.: US 8,063,876 B2
(45) Date of Patent: Nov. 22, 2011

(54) LIQUID CRYSTAL DISPLAY DEVICE

(75) Inventors: Yong Ho Jang, Gyeonggi-do (KR); Binn Kimm, Seoul (KR); Seung Chan Choi, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 848 days.

(21) Appl. No.: 12/005,313

(22) Filed: Dec. 27, 2007

(65) Prior Publication Data

US 2008/0252624 A1 Oct. 16, 2008

(30) Foreign Application Priority Data

Apr. 13, 2007 (KR) ..... 10-2007-0036559
Aug. 27, 2007 (KR) ..... 10-2007-0086117

(51) Int. Cl.
*G09G 3/36* (2006.01)

(52) U.S. Cl. ..... 345/103; 345/88

(58) Field of Classification Search ..... 345/87, 345/88, 90, 94, 99, 100, 103
See application file for complete search history.

(56) References Cited

U.S. PATENT DOCUMENTS 7,355,666 B2 * 4/2008 Song et al. ..... 349/144
7,525,527 B2 * 4/2009 Sekine ..... 345/87
7,545,305 B2 * 6/2009 Tsuchi ..... 341/144
7,679,596 B2 * 3/2010 Kim et al. ..... 345/98
7,710,374 B2 * 5/2010 Lee ..... 345/88
7,728,810 B2 * 6/2010 You et al. ..... 345/103
7,808,494 B2 * 10/2010 Lee et al. ..... 345/206
7,839,374 B2 * 11/2010 Kim et al. ..... 345/100
8,013,966 B2 * 9/2011 Do et al. ..... 349/139

* cited by examiner

*Primary Examiner* — Ricardo L Osorio
(74) *Attorney, Agent, or Firm* — Morgan, Lewis & Bockius LLP

(57) ABSTRACT

Disclosed herein is a liquid crystal display device which is capable of reducing the number of data drive integrated circuits (ICs) to curtail a production cost. The liquid crystal display device includes a plurality of pixel cells formed respectively in areas defined by a plurality of gate lines and a plurality of data lines, a first unit pixel including at least three of the pixel cells, the at least three pixel cells being connected to different ones of the data lines, and a second unit pixel including at least three of the pixel cells other than the at least three pixel cells of the first unit pixel, the at least three pixel cells of the second unit pixel being connected respectively to the different data lines to which the at least three pixel cells of the first unit pixel are connected, wherein the first and second unit pixels are arranged in a direction of the data lines and connected to different ones of the gate lines. A plurality of adjacent pixel cells expressing the same colors or different colors on horizontal lines, among the pixel cells, are connected in common to the same data lines.

5 Claims, 27 Drawing Sheets

FIG. 4

| | | | | | | | | | | | |
|---|---|---|---|---|---|---|---|---|---|---|---|
| − R | + G | − B | + R | − G | + B | − R | + G | − B | + R | − G | + B |
| + R | − G | + B | − R | + G | − B | + R | − G | + B | − R | + G | − B |
| + R | − G | + B | − R | + G | − B | + R | − G | + B | − R | + G | − B |
| − R | + G | − B | + R | − G | + B | − R | + G | − B | + R | − G | + B |
| − R | + G | − B | + R | − G | + B | − R | + G | − B | + R | − G | + B |

FIG. 8

| | | | | | | | | | | | |
|---|---|---|---|---|---|---|---|---|---|---|---|
| + R | − G | + B | − R | + G | − B | + R | − G | + B | − R | + G | − B |
| + R | − G | + B | − R | + G | − B | + R | − G | + B | − R | + G | − B |
| + R | − G | + B | − R | + G | − B | + R | − G | + B | − R | + G | − B |
| + R | − G | + B | − R | + G | − B | + R | − G | + B | − R | + G | − B |
| + R | − G | + B | − R | + G | − B | + R | − G | + B | − R | + G | − B |

FIG. 11

| | | | | | | | | | | | |
|---|---|---|---|---|---|---|---|---|---|---|---|
| + R | − G | + B | + R | − G | + B | − R | + G | − B | − R | + G | − B |
| − R | + G | − B | − R | + G | − B | + R | − G | + B | + R | − G | + B |
| + R | − G | + B | + R | − G | + B | − R | + G | − B | − R | + G | − B |
| − R | + G | − B | − R | + G | − B | + R | − G | + B | + R | − G | + B |
| + R | − G | + B | + R | − G | + B | − R | + G | − B | − R | + G | − B |

FIG. 13

| | | | | | | | | | | | |
|---|---|---|---|---|---|---|---|---|---|---|---|
| + R | − G | + B | − R | + G | − B | + R | − G | + B | − R | + G | − B |
| + R | − G | + B | − R | + G | − B | + R | − G | + B | − R | + G | − B |
| − R | + G | − B | + R | − G | + B | − R | + G | − B | + R | − G | + B |
| − R | + G | − B | + R | − G | + B | − R | + G | − B | + R | − G | + B |
| + R | − G | + B | − R | + G | − B | + R | − G | + B | − R | + G | − B |

FIG. 16

| | | | | | | | | | | | |
|---|---|---|---|---|---|---|---|---|---|---|---|
| + R | − G | + B | − R | + G | − B | + R | − G | + B | − R | + G | − B |
| + R | − G | + B | − R | + G | − B | + R | − G | + B | − R | + G | − B |
| − R | + G | − B | + R | − G | + B | − R | + G | − B | + R | − G | + B |
| − R | + G | − B | + R | − G | + B | − R | + G | − B | + R | − G | + B |
| + R | − G | + B | − R | + G | − B | + R | − G | + B | − R | + G | − B |

FIG. 18

| | | | | | | | | | | | |
|---|---|---|---|---|---|---|---|---|---|---|---|
| + R | − G | + B | − R | + G | − B | + R | − G | + B | − R | + G | − B |
| + R | − G | + B | − R | + G | − B | + R | − G | + B | − R | + G | − B |
| + R | − G | + B | − R | + G | − B | + R | − G | + B | − R | + G | − B |
| + R | − G | + B | − R | + G | − B | + R | − G | + B | − R | + G | − B |
| + R | − G | + B | − R | + G | − B | + R | − G | + B | − R | + G | − B |

FIG. 21

| | | | | | | |
|---|---|---|---|---|---|---|
| − R | + G | − B | + R | − G | + B | − R |
| + R | − G | + B | − R | + G | − B | + R |
| − R | + G | − B | + R | − G | + B | − R |
| + R | − G | + B | − R | + G | − B | + R |
| − R | + G | − B | + R | − G | + B | − R |

FIG. 24

| | | | | | |
|---|---|---|---|---|---|
| + $R_{11}$ | − $G_{11}$ | + $B_{11}$ | − $R_{12}$ | + $G_{12}$ | − $B_{12}$ |
| + $R_{21}$ | − $G_{21}$ | + $B_{21}$ | − $R_{22}$ | + $G_{22}$ | − $B_{22}$ |
| − $R_{31}$ | + $G_{31}$ | − $B_{31}$ | + $R_{32}$ | − $G_{32}$ | + $B_{32}$ |
| − $R_{41}$ | + $G_{41}$ | − $B_{41}$ | + $R_{42}$ | − $G_{42}$ | + $B_{42}$ |
| + $R_{51}$ | − $G_{51}$ | + $B_{51}$ | − $R_{52}$ | + $G_{52}$ | − $B_{52}$ |

FIG. 27

| | | | | | | |
|---|---|---|---|---|---|---|
| + R | + G | − B | − R | + G | + B | − R |
| − R | − G | + B | + R | − G | − B | + R |
| + R | + G | − B | − R | + G | + B | − R |
| − R | − G | + B | + R | − G | − B | + R |
| + R | + G | − B | − R | + G | + B | − R |
| − R | − G | + B | + R | − G | − B | + R |

LIQUID CRYSTAL DISPLAY DEVICE

This application claims the benefit of the Korean Patent Application No. 10-2007-036559 & 10-2007-086117, filed on Apr. 13, 2007 & Aug. 27, 2007, which is hereby incorporated by reference as if fully set forth herein.

BACKGROUND OF THE INVENTION

1. Field of the Invention

The present invention relates to a liquid crystal display device, and more particularly, to a liquid crystal display device which is capable of reducing the number of data drive integrated circuits (ICs) to curtail a production cost.

2. Discussion of the Related Art

In recent informationized society, displays are visual information transfer media, whose importance is emphasized than ever. Various flat panel displays have been developed.

These flat panel displays may be, for example, a liquid crystal display (LCD), field emission display (FED), plasma display panel (PDP), electroluminescence (EL) display, organic light emitting diode (OLED), and the like.

The liquid crystal display, among the flat panel displays, is on a trend of being applied within a wider range owing to its characteristics of lightness, thinness, low power consumption driving, etc. According to such a trend, the liquid crystal display has been used in a portable computer such as a notebook personal computer (PC), an office automation device, an audio/video device, an indoor/outdoor advertisement display device, etc., and been rapidly advanced toward a larger size and higher resolution owing to recent security of mass production technologies and recent results of research and development.

In general, a liquid crystal display device is adapted to adjust light transmittance of liquid crystal cells according to a video signal so as to display an image. This liquid crystal display device basically includes a liquid crystal display panel including liquid crystal cells arranged between two glass substrates in matrix form for displaying an image, a backlight unit for emitting light to the liquid crystal display panel, and a driving circuit for supplying a drive signal to drive the liquid crystal display panel.

FIG. 1 schematically shows the configuration of a conventional liquid crystal display device.

Referring to FIG. 1, the conventional liquid crystal display device, denoted by reference numeral 1, includes a liquid crystal display panel 10 including pixel areas formed respectively in areas defined by a plurality of gate lines GL1 to GLm and a plurality of data lines DL1 to DLn, a gate driver 30 for sequentially supplying a gate drive signal to the gate lines GL1 to GLm, a data driver 20 for supplying video data Red, Green and Blue inputted thereto to the data lines DL1 to DLn synchronously with the gate drive signal, and a timing controller 40 for converting and arranging external video data R, G and B and supplying the resulting video data to the data driver 20, and controlling the driving of the gate driver 30 and data driver 20.

Although not shown, the liquid crystal display device further includes a backlight unit for emitting light to the liquid crystal display panel 10, an inverter for applying a voltage and current to the backlight unit, a reference gamma voltage generator for generating a reference gamma voltage and supplying it to the data driver 20, and a voltage generator for generating a drive voltage to drive each component and supplying a common voltage Vcom to a common electrode of the liquid crystal display panel 10.

The liquid crystal display panel 10 includes a transistor array substrate and a color filter array substrate bonded to face each other, a spacer for keeping a cell gap between the two array substrates constant, and a liquid crystal filled in a space provided by the spacer.

The liquid crystal display panel 10 further includes thin film transistors (TFTs) formed respectively in pixel areas defined by the m gate lines GL1 to GLm and the n data lines DL1 to DLn, and pixel cells connected respectively to the TFTs.

Each TFT supplies an analog video data signal from a corresponding one of the data lines DL1 to DLn to a corresponding one of the pixel cells in response to a gate drive signal from a corresponding one of the gate lines GL1 to GLm.

Each pixel cell can be equivalently expressed as a liquid crystal capacitor Clc because it is provided with a common electrode facing via the liquid crystal, and a pixel electrode connected to the corresponding TFT. This pixel cell includes a storage capacitor Cst for maintaining an analog video data signal charged on the liquid crystal capacitor Clc until the next analog video data signal is charged thereon. The common voltage Vcom is supplied to the common electrode of the pixel cell.

Each TFT has a gate electrode connected to a corresponding one of the gate lines GL1 to GLm, a source electrode connected to a corresponding one of the data lines DL1 to DLn, and a drain electrode connected to the pixel electrode of the corresponding pixel cell.

On the color filter array substrate of the liquid crystal display panel 10, red (R), green (G) and blue (B) color filters are vertically striped and formed in matrix form.

The timing controller 40 arranges video data R, G and B inputted from a digital video card on a frame-by-frame basis and supplies the arranged video data to the data driver 20.

Also, the timing controller 40 generates a data control signal DCS and a gate control signal GCS using a dot clock DCLK, a data enable signal DE, and horizontal and vertical synchronous signals Hsync and Vsync externally inputted thereto, and applies the generated data control signal DCS and gate control signal GCS respectively to the data and gate drivers 20 and 30 to control the driving timings thereof.

Here, the data control signal DCS includes a source shift clock SSC, source start pulse SSP, polarity control signal POL and source output enable signal SOE, and the gate control signal GCS includes a gate start pulse GSP, gate shift clock GSC and gate output enable signal GOE.

The gate driver 30 includes a shift register for sequentially generating a gate drive signal (gate scan pulse) in response to the gate control signal GCS from the timing controller 40.

This gate driver 30 sequentially applies the gate drive signal to the gate lines GL1 to GLm in response to the gate control signal GCS from the timing controller 40, so as to turn on the TFTs connected respectively to the gate lines GL1 to GLm. At this time, the gate driver 30 determines a high-level voltage and low-level voltage of the gate drive signal depending on a gate high voltage VGH and gate low voltage VGL inputted thereto.

The data driver 20 supplies analog video data signals to the data lines DL1 to DLn at intervals at which the gate drive signal is supplied, in response to the data control signal DCS supplied from the timing controller 40. At this time, the data driver 20 inverts the polarities of the analog video data signals to be supplied to the data lines DL1 to DLn in response to the polarity control signal POL.

In the above-mentioned conventional liquid crystal display device, red (R), green (G) and blue (B) color filters formed in the liquid crystal display panel are vertically striped and three horizontally adjacent red (R), green (G) and blue (B) color pixels are combined to constitute one unit pixel. As a result, the liquid crystal display device needs 3×n data lines DL and 1×m gate lines to express m×n resolution.

A large number of data drive ICs are required to supply video data to the 3×n data lines DL. However, the data drive ICs are costly, resulting in an increase in manufacturing cost of the liquid crystal display device.

SUMMARY OF THE INVENTION

Accordingly, the present invention is directed to a liquid crystal display device that substantially obviates one or more problems due to limitations and disadvantages of the related art.

An object of the present invention is to provide a liquid crystal display device which is capable of reducing the number of costly data drive ICs to curtail a production cost.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device comprises: a gate driver for sequentially supplying a drive signal to a plurality of gate lines; a data driver for supplying video data signals respectively to a plurality of data lines; a plurality of pixel cells formed respectively in areas defined by the gate lines and the data lines; a first unit pixel including at least three of the pixel cells, the at least three pixel cells being connected to different ones of the data lines; and a second unit pixel including at least three of the pixel cells other than the at least three pixel cells of the first unit pixel, the at least three pixel cells of the second unit pixel being connected respectively to the different data lines to which the at least three pixel cells of the first unit pixel are connected, wherein the first and second unit pixels are arranged in a direction of the data lines and connected to different ones of the gate lines.

In another aspect of the present invention, a liquid crystal display device comprises: a gate driver for sequentially supplying a drive signal to a plurality of gate lines; a data driver for supplying video data signals respectively to a plurality of data lines; and a plurality of pixel cells formed respectively in areas defined by the gate lines and the data lines, wherein a plurality of adjacent pixel cells expressing the same colors or different colors on horizontal lines, among the pixel cells, are connected in common to the same data lines.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 4 is a view showing polarity variations of video data which is charged in a liquid crystal display panel through the video data shown in FIG. 3;

FIG. 8 is a view showing polarity variations of video data which is charged in a liquid crystal display panel through the video data shown in FIG. 7;

FIG. 11 is a view showing polarity variations of video data which is charged in a liquid crystal display panel through the video data shown in FIG. 10;

FIG. 13 is a view showing polarity variations of video data which is charged in a liquid crystal display panel through the video data shown in FIG. 12;

FIG. 16 is a view showing polarity variations of video data which is charged in a liquid crystal display panel through the video data shown in FIG. 15;

FIG. 18 is a view showing polarity variations of video data which is charged in a liquid crystal display panel through the video data shown in FIG. 17;

FIG. 21 is a view showing polarity variations of video data which is charged in a liquid crystal display panel through the video data shown in FIG. 20;

FIG. 24 is a view showing polarity variations of video data which is charged in a liquid crystal display panel through the video data shown in FIG. 23;

FIG. 27 is a view showing polarity variations of video data which is charged in a liquid crystal display panel through the video data shown in FIG. 26.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 2:
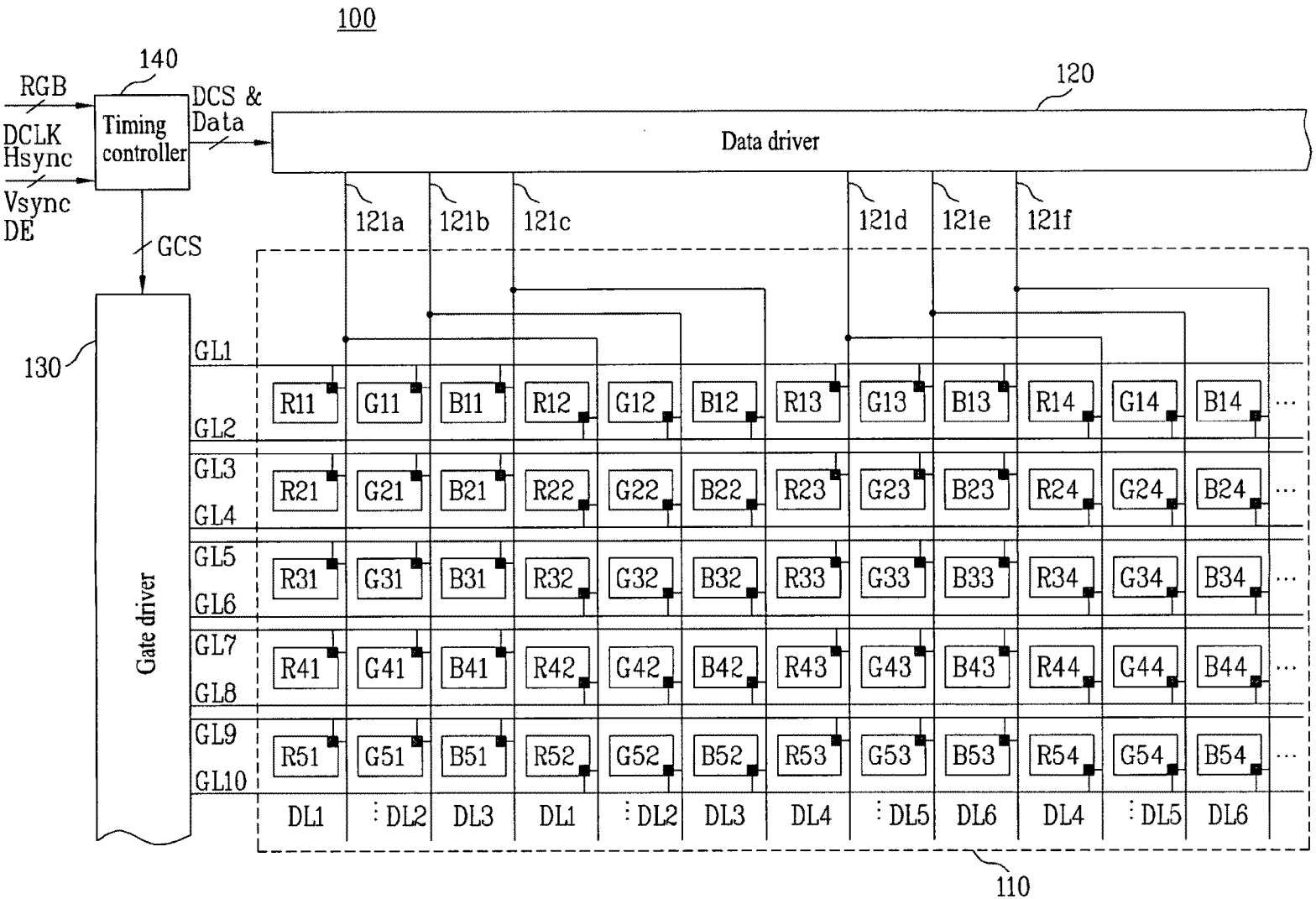
FIG. 2 is a view showing the configuration of a liquid crystal display device according to a first embodiment of the present invention.

FIG. 2 shows the configuration of a liquid crystal display device according to a first embodiment of the present invention.

Only part of the entire area of the liquid crystal display panel is shown in FIG. 2.

Referring to FIG. 2, the liquid crystal display device according to the first embodiment of the present invention, denoted by reference numeral 100, includes a liquid crystal display panel 110 including a plurality of pixel areas formed respectively in areas defined by a plurality of gate lines GL1 to GLm and a plurality of data lines DL1 to DLn, a gate driver 130 for sequentially supplying a gate drive signal to the gate lines GL1 to GLm, a data driver 120 for supplying video data R, G and B inputted thereto to the data lines DL1 to DLn synchronously with the gate drive signal, and a timing controller 140 for converting and arranging external video data R, G and B and supplying the resulting video data to the data driver 120, and controlling the driving of the gate driver 130 and data driver 120.

Here, the data lines DL1 to DL6 receive analog video data signals outputted from the data driver 120 over channels 121*a* to 121*f* corresponding respectively thereto.

Although not shown, the liquid crystal display device 100 according to the first embodiment of the present invention further includes a backlight unit for emitting light to the liquid crystal display panel 110, an inverter for applying a voltage and current to the backlight unit, a reference gamma voltage generator for generating a reference gamma voltage and supplying it to the data driver 120, and a voltage generator for generating a drive voltage to drive each component and supplying a common voltage Vcom to a common electrode of the liquid crystal display panel 110.

In FIG. 2, only some, GL1 to GL10, of the plurality of gate lines GL1 to GLm are shown. Also, only some, DL1 to DL6, of the plurality of data lines DL1 to DLn are shown. Thus, only some, 121*a* to 121*f*, of the channels corresponding to the plurality of data lines DL1 to DLn are also shown.

The liquid crystal display panel 110 of the liquid crystal display device 100 according to the first embodiment of the present invention includes a transistor array substrate and a color filter array substrate bonded to face each other, a spacer for keeping a cell gap between the two array substrates constant, and a liquid crystal filled in a space provided by the spacer.

The liquid crystal display panel 110 further includes, as shown in FIG. 2, m gate lines GL1 to GLm formed in a horizontal direction, n data lines DL1 to DLn formed in a vertical direction and each connected in common to horizontally adjacent pixel cells expressing the same color, TFTs formed respectively in pixel areas defined by the m gate lines GL1 to GLm and the n data lines DL1 to DLn, and pixel cells connected respectively to the TFTs.

In more detail, pixel cells R11 to B1*n* are formed on a first horizontal line formed between the first gate line GL1 and the second gate line GL2, and pixel cells R21 to B2*n* are formed on a second horizontal line formed between the third gate line GL3 and the fourth gate line GL4.

Subsequently, pixel cells of three colors (R, G and B) are alternately formed on a horizontal line formed between each pair of gate lines GL, as stated above, up to the mth gate line GLm.

Adjacent pixel cells of the three colors (R, G and B), among a plurality of pixel cells formed on one horizontal line, constitute one unit pixel. Odd ones of these unit pixels are connected to the odd gate lines GL1, GL3, . . . , GLm−1, respectively, and even ones thereof are connected to the even gate lines GL2, GL4, . . . , GLm, respectively.

In a pair of adjacent unit pixels on one horizontal line, pixel cells expressing the same colors, among pixel cells of the three colors (R, G and B) constituting the respective unit pixels, are connected in common to the same data lines DL.

For example, among the pixel cells R11 to B1*n* formed on the first horizontal line, the red pixel cells "R11" and "R12" expressing the same color are connected in common to the first data line DL1, the green pixel cells "G11" and "G12" expressing the same color are connected in common to the second data line DL2, and the blue pixel cells "B11" and "B12" expressing the same color are connected in common to the third data line DL3.

This is also equally applied to the subsequently arranged pixel cells. That is, as stated above, in a pair of adjacent unit pixels, pixel cells expressing the same colors, among pixel cells of the three colors (R, G and B) constituting the respective unit pixels, are connected in common to the same data lines DL.

Each TFT supplies an analog video data signal from a corresponding one of the data lines DL1 to DLn to a corresponding one of the pixel cells in response to a gate drive signal (scan signal) from a corresponding one of the gate lines GL1 to GLm.

Each pixel cell can be equivalently expressed as a liquid crystal capacitor Clc because it is provided with a common electrode facing via the liquid crystal, and a pixel electrode connected to the corresponding TFT. This pixel cell includes a storage capacitor Cst for maintaining an analog video data signal charged on the liquid crystal capacitor Clc until the next analog video data signal is charged thereon. The common voltage Vcom is supplied to the common electrode of the pixel cell.

Each TFT has a gate electrode connected to a corresponding one of the gate lines GL1 to GLm, a source electrode connected to a corresponding one of the data lines DL1 to DLn, and a drain electrode connected to the pixel electrode of the corresponding pixel cell.

On the color filter array substrate of the liquid crystal display panel 110, red (R), green (G) and blue (B) color filters are vertically striped.

Through this arrangement of the color filters, pixel cells of the same colors are arranged in the vertical direction and R, G and B pixel cells are alternately arranged in the horizontal direction. As a result, these pixel cells are arranged in matrix form.

The timing controller 140 arranges video data R, G and B inputted from a digital video card on a frame-by-frame basis and supplies the arranged video data to the data driver 120. The data driver 120 includes a plurality of data drive ICs to supply video data signals to a plurality of data lines.

The timing controller 140 also generates a data control signal DCS and a gate control signal GCS using a dot clock DCLK, a data enable signal DE, and horizontal and vertical synchronous signals Hsync and Vsync externally inputted thereto, and applies the generated data control signal DCS and gate control signal GCS respectively to the data and gate drivers 120 and 130 to control the driving timings thereof.

Here, the data control signal DCS includes a source shift clock SSC, source start pulse SSP, polarity control signal POL and source output enable signal SOE.

The gate control signal GCS includes a gate start pulse GSP, gate shift clock GSC and gate output enable signal GOE.

The gate driver 130 includes a shift register for sequentially generating a gate drive signal (gate scan pulse) in response to the gate control signal GCS from the timing controller 140.

This gate driver 130 sequentially applies the gate drive signal (scan signal) to the gate lines GL1 to GLm in response to the gate control signal GCS from the timing controller 140, so as to turn on the TFTs connected respectively to the gate lines GL1 to GLm.

At this time, the gate driver 130 determines a high-level voltage and low-level voltage of the gate drive signal depending on a gate high voltage VGH and gate low voltage VGL inputted thereto. This gate driver may be implemented directly on a glass substrate.

The data driver 120 supplies analog video data signals to the data lines DL1 to DLn at intervals at which the gate drive signal is supplied, in response to the data control signal DCS supplied from the timing controller 140. At this time, the data driver 120 inverts the polarities of the analog video data signals to be supplied to the data lines DL1 to DLn in response to the polarity control signal POL.

This data driver 120 internally includes a plurality of data drive ICs. Analog video data signals outputted from the plurality of data drive ICs are supplied respectively to the plurality of data lines DL1 to DLn formed in the liquid crystal display panel 110 over the plurality of channels 121 corresponding respectively to the plurality of data lines DL1 to DLn.

A frame inversion system, line inversion system, column inversion system, and dot inversion system are all applicable to the liquid crystal display device 100 according to the first embodiment of the present invention to drive the liquid crystal display device 100.

In the following detailed description, one of the above-stated driving systems will be taken as an example. A detailed description will hereinafter be given of the application of a 2-dot inversion system to the liquid crystal display device 100 according to the first embodiment of the present invention for the purpose of preventing crosstalk and flickering and realizing low power consumption. In the 2-dot inversion system, analog video signals which are charged in the liquid crystal display panel 110 have different polarities for every two vertically adjacent pixel cells.

Figure 3:
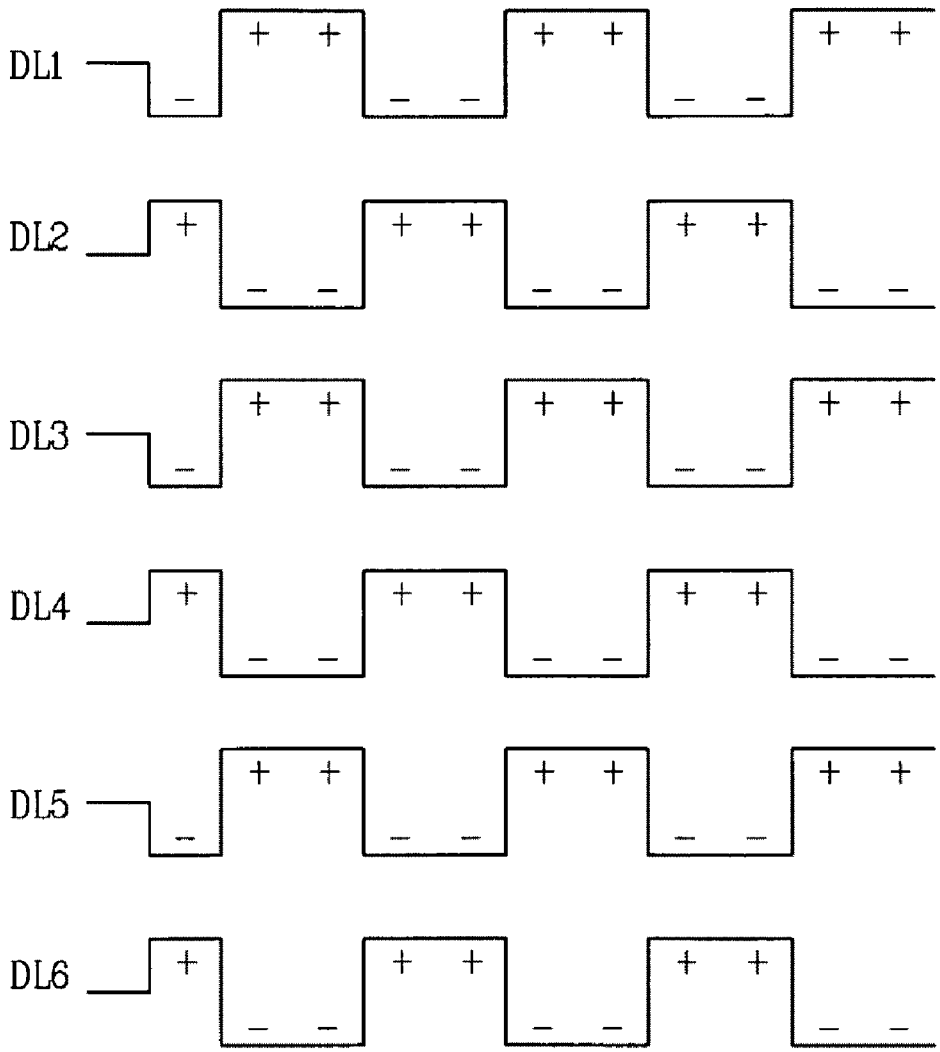
FIG. 3 is a waveform diagram of video data which is applied to data lines of the liquid crystal display device according to the first embodiment of the present invention.

FIG. 3 is a waveform diagram of video data which is applied to the data lines of the liquid crystal display device according to the first embodiment of the present invention, and FIG. 4 is a view showing polarity variations of video data which is charged in the liquid crystal display panel through the video data shown in FIG. 3.

A driving method of the liquid crystal display device according to the first embodiment of the present invention will hereinafter be described with reference to FIGS. 2 to 4.

In the liquid crystal display device 100 according to the first embodiment of the present invention, TFTs connected respectively to vertically arranged red (R), green (G) and blue (B) pixel cells are turned on sequentially in the vertical direction in one frame period. To this end, the gate drive signal (scan signal) is applied to the m gate lines GL1 to GLm sequentially from the first gate line GL1 to the mth gate line GLm.

If the first gate drive signal is applied to the first gate line GL1 during one frame period, TFTs connected respectively to pixel cells R11, G11, B11, R13, G13, B13, . . . constituting odd unit pixels on the first horizontal line are turned on.

Thereafter, if the second gate drive signal is applied to the second gate line GL2, TFTs connected respectively to pixel cells R12, G12, B12, R14, G14, B14, . . . constituting even unit pixels on the first horizontal line are turned on.

Then, if the third gate drive signal is applied to the third gate line GL3, TFTs connected respectively to pixel cells R21, G21, B21, R23, G23, B23, . . . constituting odd unit pixels on the second horizontal line are turned on.

Thereafter, if the fourth gate drive signal is applied to the fourth gate line GL4, TFTs connected respectively to pixel cells R22, G22, B22, R24, G24, B24, . . . constituting even unit pixels on the second horizontal line are turned on.

Subsequently, if the fifth to mth gate drive signals are applied respectively to the fifth to mth gate lines GL5 to GLm, TFTs connected to each of those gate lines are turned on to drive the corresponding pixel cells, respectively, as stated above.

If the gate drive signal is sequentially applied to the first to mth gate lines, analog video data signals as shown in FIG. 3 are applied to the respective data lines DL1 to DLn at intervals at which the gate drive signal is supplied.

If analog video data signals which are inverted in polarity on a 2-pixel basis as shown in FIG. 3 are applied to the data lines DL1 to DLn, video data signals which are inverted in polarity on a 1-dot basis in the horizontal direction and on a 2-dot basis in the vertical direction as shown in FIG. 4 are charged in the pixel cells of the liquid crystal display panel 110.

In a driving system of a liquid crystal display device having a general structure to reduce the number of data lines, a gate drive signal is driven in such a manner that it has a short duration 1H. If the gate drive signal is driven with the short duration 1H, a phenomenon in which a video data signal to be supplied through a data line DL is not charged may occur. In order to prevent this uncharged phenomenon, the gate drive signal is driven in an overlap manner.

However, if the gate drive signal is driven in the overlap manner, the picture quality of images which are displayed in the charging order of video data signals in pixel cells may be degraded due to precharging of the video data signals in the pixel cells.

Figure 5:
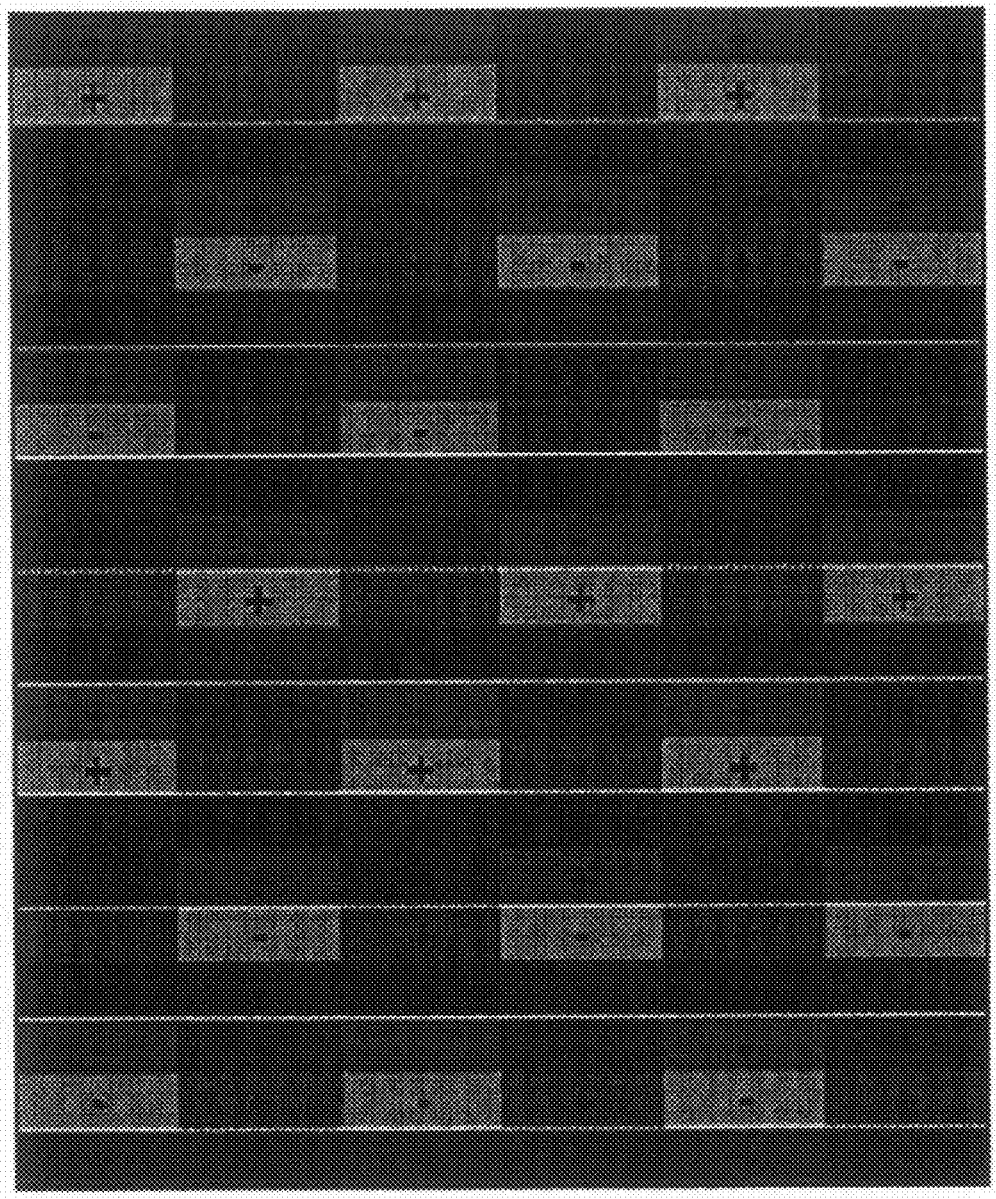
FIG. 5 is a view showing a super pixel gray pattern test of the liquid crystal display device according to the first embodiment of the present invention.

As a test pattern to test this picture quality degradation is used a super pixel gray pattern test in which one of up, down, left and right adjacent unit pixels is turned on and the other unit pixels are turned off. When the super pixel gray pattern test is performed with respect to the liquid crystal display device according to the first embodiment of the present invention, all pixel cells expressing the green color are precharged by black video data, as shown in FIG. 5, so as to prevent the picture quality from being degraded due to a charging difference among the video data signals. As a result, it is possible to reduce the number of data drive ICs of the liquid crystal display device without degrading the display quality of the display device.

Figure 1:
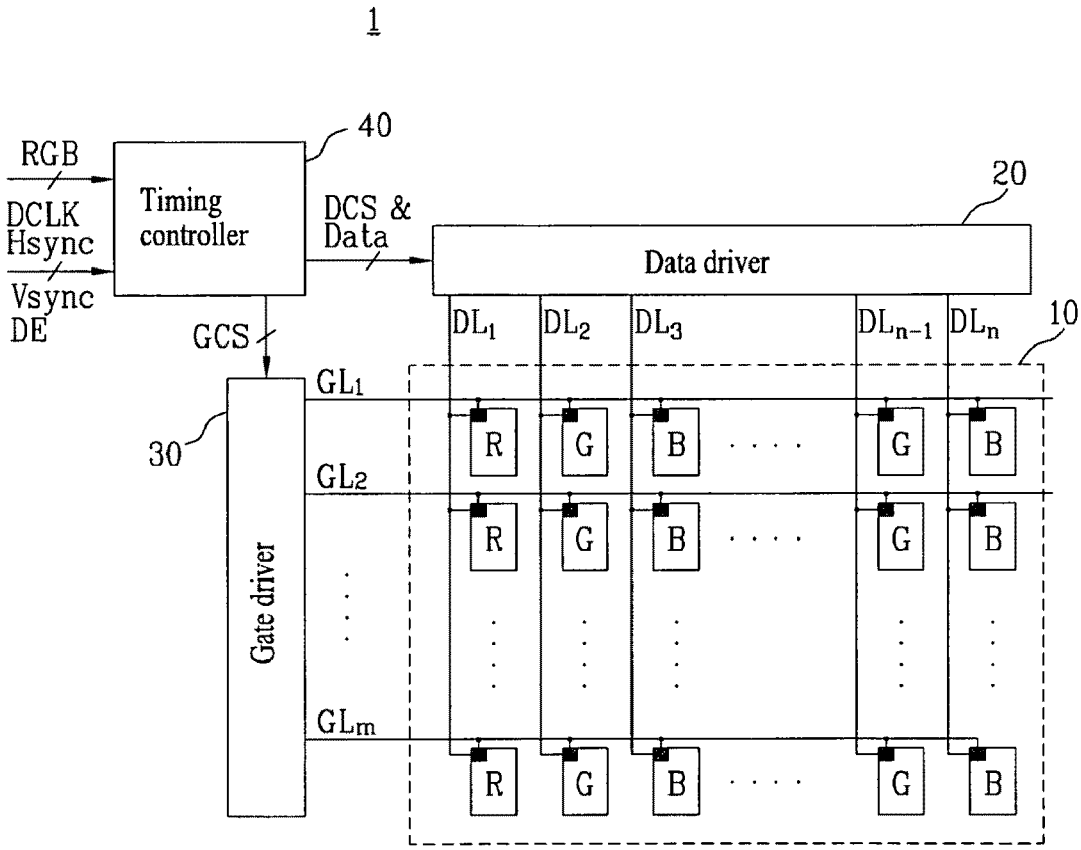
FIG. 1 is a schematic view of a conventional liquid crystal display device.

In the liquid crystal display device according to the first embodiment of the present invention, through the above-stated configuration, pixel cells expressing the same colors, among respective three-color pixel cells constituting a pair of adjacent unit pixels, are connected in common to the same data lines, thereby making it possible to reduce the number of costly data drive ICs to ½ that in the conventional liquid crystal display device shown in FIG. 1. Therefore, it is possible to reduce the manufacturing cost of the liquid crystal display device.

Figure 6:
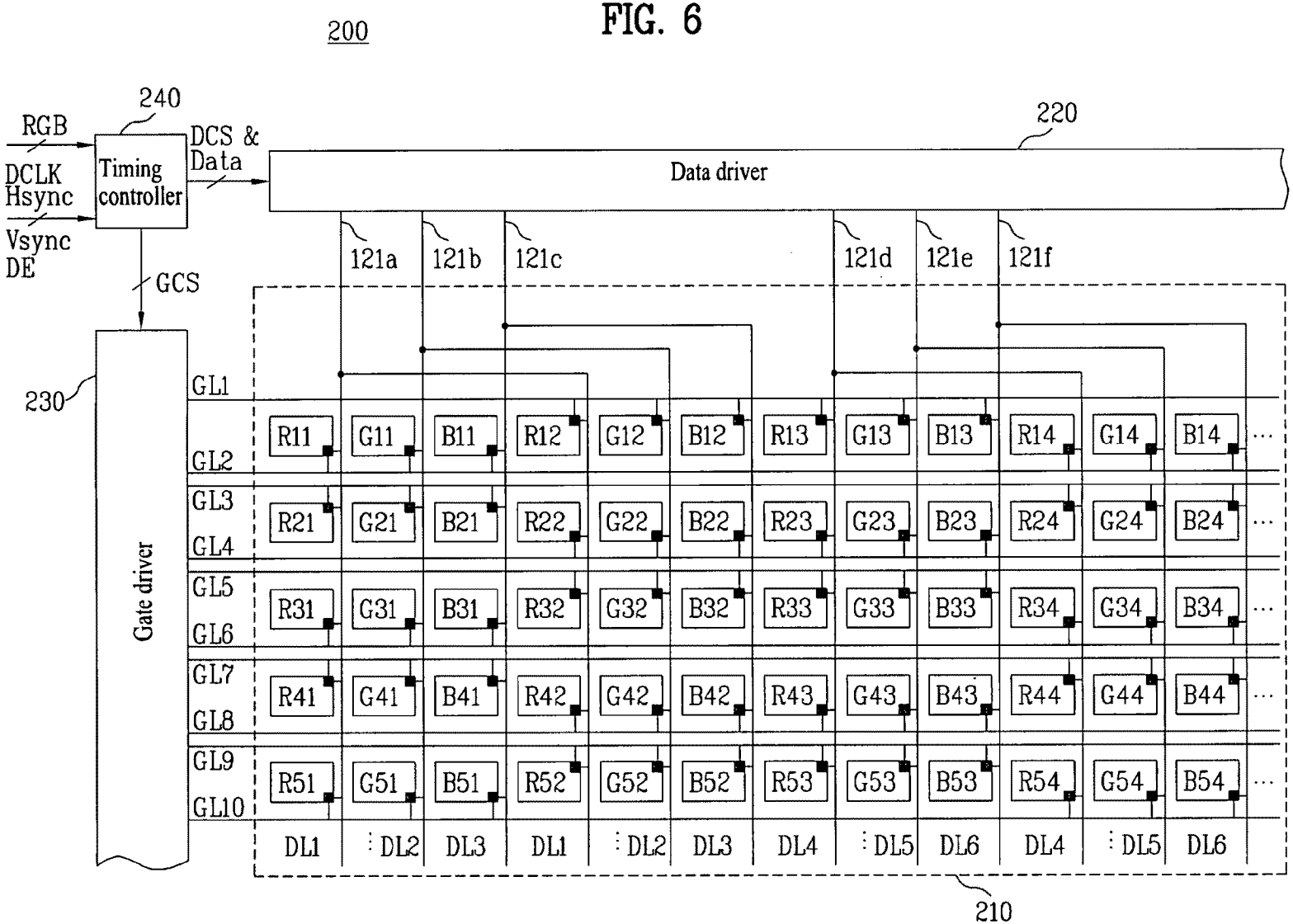
FIG. 6 is a view showing the configuration of a liquid crystal display device according to a second embodiment of the present invention.

FIG. 6 shows the configuration of a liquid crystal display device according to a second embodiment of the present invention.

The liquid crystal display device according to the second embodiment of the present invention, denoted by reference numeral 200, is the same in configuration as the liquid crystal display device 100 according to the first embodiment of the present invention, with the exception of connections of gate lines GL, data lines DL and pixel cells in a liquid crystal display panel 210, and a detailed description of the same constituent elements will thus be omitted.

Referring to FIG. 6, the liquid crystal display device 200 according to the second embodiment of the present invention includes a liquid crystal display panel 210 including m gate lines GL1 to GLm formed in a horizontal direction, n data lines DL1 to DLn formed in a vertical direction and each connected in common to adjacent pixel cells expressing the same color, TFTs formed respectively in pixel areas defined by the m gate lines GL1 to GLm and the n data lines DL1 to DLn, and pixel cells connected respectively to the TFTs.

The liquid crystal display device 200 according to the second embodiment of the present invention further includes a gate driver 230 for sequentially supplying a gate drive signal to the gate lines GL1 to GLm, a data driver 220 for supplying video data R, G and B inputted thereto to the data lines DL1 to DLn synchronously with the gate drive signal, and a timing controller 240 for converting and arranging external video data R, G and B and supplying the resulting video data to the data driver 220, and controlling the driving of the gate driver 230 and data driver 220.

Here, the data lines DL1 to DL6 receive analog video data signals outputted from the data driver 220 over channels 121*a* to 121*f* corresponding respectively thereto. In FIG. 6, there are shown only some of the gate lines GL, data lines DL and channels.

In the liquid crystal display panel 210 of the liquid crystal display device 200 according to the second embodiment of the present invention, pixel cells R11 to B1*n* are formed on a first horizontal line formed between the first gate line GL1 and the second gate line GL2, and pixel cells R21 to B2*n* are formed on a second horizontal line formed between the third gate line GL3 and the fourth gate line GL4. Subsequently, pixel cells of three colors (R, G and B) are alternately formed on a horizontal line formed between each pair of gate lines GL, as stated above, up to the mth gate line GLm.

Adjacent pixel cells of the three colors (R, G and B) on one horizontal line, among these pixel cells, constitute one unit pixel. One of two unit pixels adjacent to an arbitrary unit pixel on one horizontal line, among these unit pixels, is connected to the same gate line GL as that to which the arbitrary unit pixel is connected, and the other unit pixel is connected to a gate line GL different from that to which the arbitrary unit pixel is connected.

Describing it in detail with reference to FIG. 6 as an example, on the first horizontal line, the pixel cells "R11, G11 and B11" constitute a first unit pixel, the pixel cells "R12, G12 and B12" constitute a second unit pixel, and the pixel cells "R13, G13 and B13" constitute a third unit pixel. Here, the first unit pixel is connected to the second gate line GL2, and the second unit pixel and third unit pixel are connected to the first gate line GL1.

In terms of the second unit pixel, the first unit pixel positioned at the left-hand side of the second unit pixel is connected to the second gate line GL2 different from the first gate line GL1 to which the second unit pixel is connected. In contrast, the third unit pixel positioned at the right-hand side of the second unit pixel is connected to the same first gate line GL1 as that to which the second unit pixel is connected.

In addition to these gate line connections, in a pair of unit pixels connected to different gate lines GL, pixel cells expressing the same colors, among pixel cells of the three colors (R, G and B) constituting the respective unit pixels, are connected in common to the same data lines DL.

For example, among the pixel cells "R11" to "B1*n*" formed on the first horizontal line, the red pixel cells "R11" and "R12" connected to different gate lines GL and expressing the same color are connected in common to the first data line DL1, the green pixel cells "G11" and "G12" connected to the different gate lines GL and expressing the same color are connected in common to the second data line DL2, and the blue pixel cells "B11" and "B12" connected to the different gate lines GL and expressing the same color are connected in common to the third data line DL3.

This is also equally applied to the subsequently arranged pixel cells. That is, as stated above, in a pair of adjacent unit pixels, a plurality of pixel cells connected to different gate lines GL and expressing the same colors, among pixel cells of the three colors (R, G and B) constituting the respective unit pixels, are connected in common to the same data lines DL.

A frame inversion system, line inversion system, column inversion system, and dot inversion system are all applicable to the liquid crystal display device 200 according to the second embodiment of the present invention to drive the liquid crystal display device 200.

A detailed description will hereinafter be given of the application of the column inversion system, among the above-stated driving systems, to the liquid crystal display device 200 according to the second embodiment of the present invention. In the column inversion system, the polarities of video data signals which are charged in the liquid crystal display panel 210 are inverted on a 1-dot basis in the horizontal direction and are the same in the vertical direction.

Figure 7:
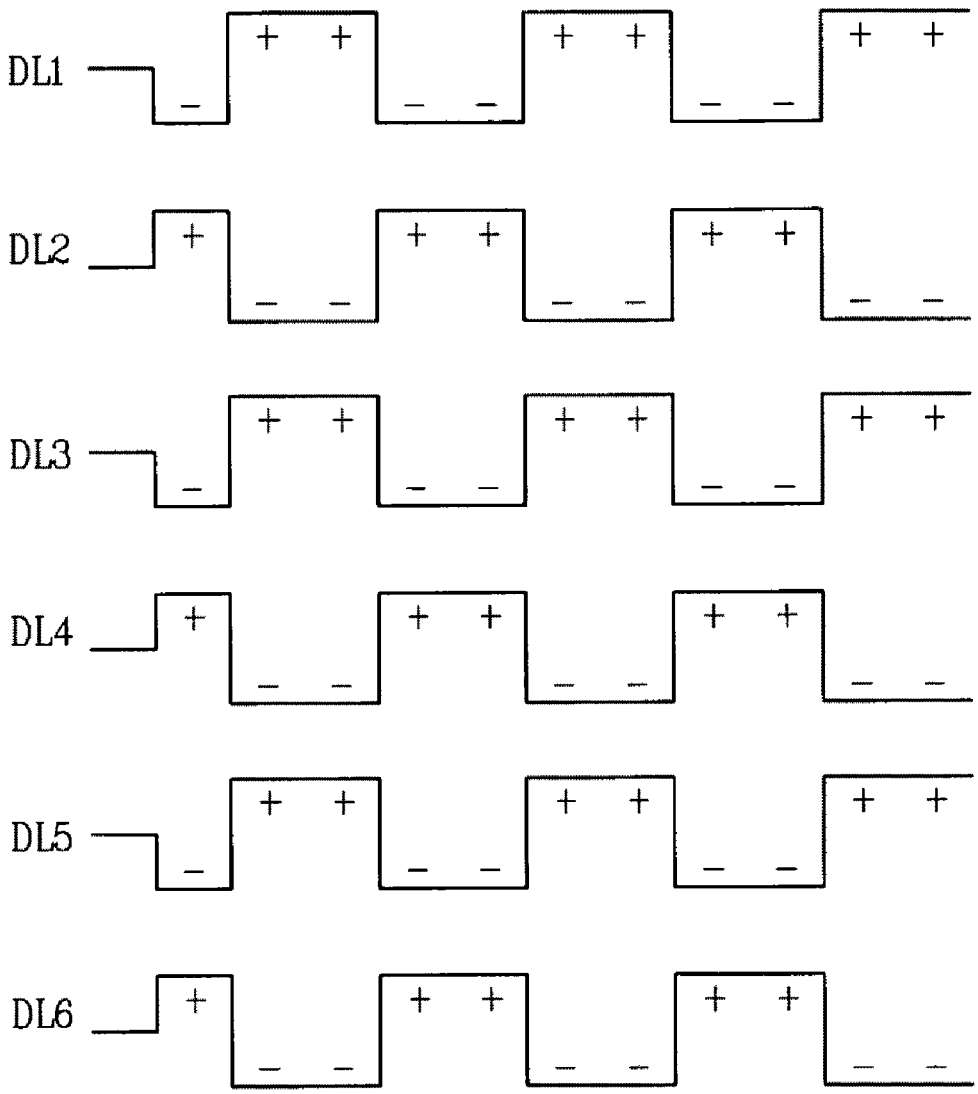
FIG. 7 is a waveform diagram of video data which is applied to data lines of the liquid crystal display device according to the second embodiment of the present invention.

FIG. 7 is a waveform diagram of video data which is applied to the data lines of the liquid crystal display device according to the second embodiment of the present invention, and FIG. 8 is a view showing polarity variations of video data which is charged in the liquid crystal display panel through the video data shown in FIG. 7.

A driving method of the liquid crystal display device according to the second embodiment of the present invention will hereinafter be described with reference to FIGS. 6 to 8.

In the liquid crystal display device 200 according to the second embodiment of the present invention, TFTs connected respectively to vertically arranged red (R), green (G) and blue (B) pixel cells are turned on sequentially in the vertical direction in one frame period. To this end, the gate drive signal (scan signal) is applied to the m gate lines GL1 to GLm sequentially from the first gate line GL1 to the mth gate line GLm.

If the first gate drive signal is applied to the first gate line GL1 during one frame period, TFTs of pixel cells R12, G12, B12, R13, G13, B13, . . . connected to the first gate line GL1 on the first horizontal line formed between the first gate line GL1 and the second gate line GL2 are turned on.

Thereafter, if the second gate drive signal is applied to the second gate line GL2, TFTs of pixel cells R11, G11, B11, R14, G14, B14, . . . connected to the second gate line GL2 are turned on. That is, the TFTs of the pixel cells other than the pixel cells previously turned on by the first gate drive signal inputted to the first gate line GL1, among the pixel cells on the first horizontal line formed between the first gate line GL1 and the second gate line GL2, are turned on.

Then, if the third gate drive signal is applied to the third gate line GL3, TFTs of pixel cells R21, G21, B21, R24, G24, B24, . . . connected to the third gate line GL3 on the second horizontal line formed between the third gate line GL3 and the fourth gate line GL4 are turned on.

Thereafter, if the fourth gate drive signal is applied to the fourth gate line GL4, TFTs of pixel cells R22, G22, B22, R23, G23, B23, . . . connected to the fourth gate line GL4 are turned on.

That is, the TFTs of the pixel cells other than the pixel cells previously turned on by the third gate drive signal inputted to the third gate line GL3, among the pixel cells on the second horizontal line formed between the third gate line GL3 and the fourth gate line GL4, are turned on.

Subsequently, if the fifth to mth gate drive signals are applied respectively to the fifth to mth gate lines GL5 to GLm, TFTs connected to each of those gate lines on a horizontal line formed between each pair of gate lines GL are turned on to drive the corresponding pixel cells, respectively, as stated above.

If the gate drive signal is sequentially applied to the first to mth gate lines, analog video data signals as shown in FIG. 7 are applied to the respective data lines DL1 to DLn at intervals at which the gate drive signal is supplied.

If the analog video data signals as shown in FIG. 7 are applied to the data lines DL1 to DLn, video data signals which are inverted in polarity on a 1-dot basis in the horizontal direction and on a column basis in the vertical direction as shown in FIG. 8 are charged in the pixel cells of the liquid crystal display panel 210.

When the super pixel gray pattern test is performed with respect to the liquid crystal display device according to the second embodiment of the present invention, all pixel cells are precharged by black video data, as shown in FIG. 5, so as to prevent the picture quality from being degraded due to a charging difference among the video data signals. As a result, it is possible to reduce the number of data drive ICs of the liquid crystal display device without degrading the display quality of the display device.

In the liquid crystal display device according to the second embodiment of the present invention, through the above-stated configuration, pixel cells expressing the same colors, among respective three-color pixel cells constituting a pair of adjacent unit pixels, are connected in common to the same data lines, thereby making it possible to reduce the number of costly data drive ICs to ½ that in the conventional liquid crystal display device shown in FIG. 1. Therefore, it is possible to reduce the manufacturing cost of the liquid crystal display device.

Figure 9:
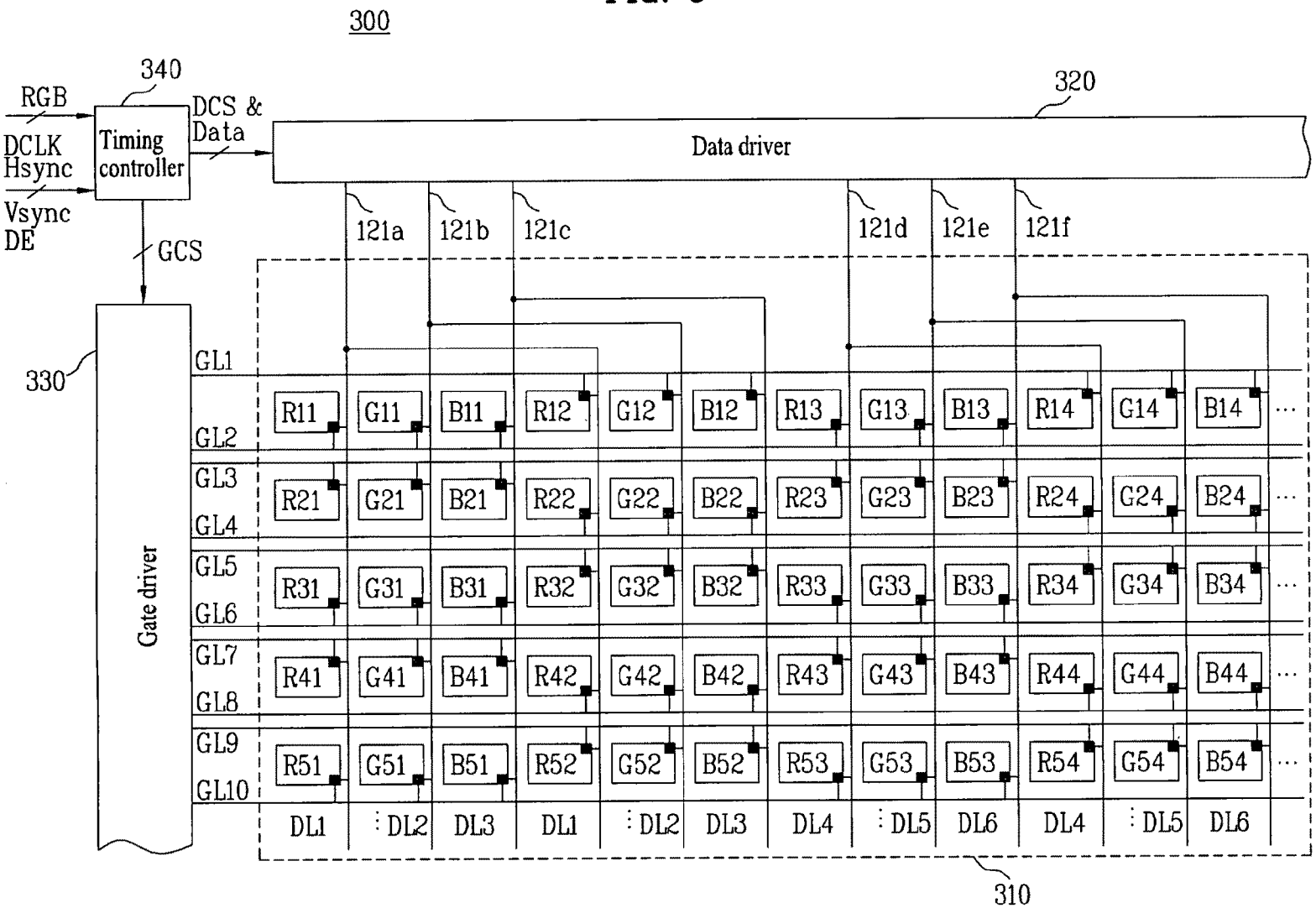
FIG. 9 is a view showing the configuration of a liquid crystal display device according to a third embodiment of the present invention.

FIG. 9 shows the configuration of a liquid crystal display device according to a third embodiment of the present invention.

The liquid crystal display device according to the third embodiment of the present invention, denoted by reference numeral 300, is the same in configuration as the liquid crystal display devices 100 and 200 according to the first and second embodiments of the present invention, with the exception of connections of gate lines GL, data lines DL and pixel cells in a liquid crystal display panel 310, and a detailed description of the same constituent elements will thus be omitted.

Referring to FIG. 9, the liquid crystal display device 300 according to the third embodiment of the present invention includes a liquid crystal display panel 310 including m gate lines GL1 to GLm formed in a horizontal direction, n data lines DL1 to DLn formed in a vertical direction and each connected in common to horizontally adjacent pixel cells expressing the same color, TFTs formed respectively in pixel areas defined by the m gate lines GL1 to GLm and the n data lines DL1 to DLn, and pixel cells connected respectively to the TFTs.

The liquid crystal display device 300 according to the third embodiment of the present invention further includes a gate driver 330 for sequentially supplying a gate drive signal to the gate lines GL1 to GLm, a data driver 320 for supplying video data R, G and B inputted thereto to the data lines DL1 to DLn synchronously with the gate drive signal, and a timing controller 340 for converting and arranging external video data R, G and B and supplying the resulting video data to the data driver 320, and controlling the driving of the gate driver 330 and data driver 320.

Here, the data lines DL1 to DL6 receive analog video data signals outputted from the data driver 320 over channels 121*a* to 121*f* corresponding respectively thereto.

In the liquid crystal display panel 310 of the liquid crystal display device 300 according to the third embodiment of the present invention, pixel cells R11 to B1*n* are formed on a first horizontal line formed between the first gate line GL1 and the second gate line GL2, and pixel cells R21 to B2*n* are formed on a second horizontal line formed between the third gate line GL3 and the fourth gate line GL4.

Then, pixel cells of three colors (R, G and B) are alternately formed between each pair of gate lines GL, as stated above, up to the mth gate line GLm.

Adjacent pixel cells of the three colors (R, G and B) on one horizontal line, among these pixel cells, constitute one unit pixel.

Two adjacent unit pixels on one horizontal line, among these unit pixels, are connected to different gate lines GL.

Describing it in detail with reference to FIG. 9 as an example, on the first horizontal line, the pixel cells "R11, G11 and B11" constitute a first unit pixel, the pixel cells "R12, G12 and B12" constitute a second unit pixel, and the pixel cells "R13, G13 and B13" constitute a third unit pixel. Here, the first unit pixel is connected to the second gate line GL2, the second unit pixel is connected to the first gate line GL1, and the third unit pixel is connected to the second gate line GL2.

In terms of the second unit pixel, the first unit pixel and third unit pixel positioned respectively at the left-hand side and right-hand side of the second unit pixel are connected to the second gate line GL2 different from the first gate line GL1 to which the second unit pixel is connected.

In addition to these gate line connections, in a pair of adjacent unit pixels connected to different gate lines GL, pixel cells expressing the same colors, among pixel cells of the three colors (R, G and B) constituting the respective unit pixels, are connected in common to the same data lines DL.

For example, among the pixel cells R11 to B1*n* on the first horizontal line formed between the first gate line GL1 and the second gate line GL2, the pixel cell R12 connected to the first gate line GL1 and expressing the red color and the pixel cell R11 connected to the second gate line GL2 and expressing the red color are connected in common to the same first data line DL1. That is, the red pixel cells R11 and R12 connected to the different gate lines GL and expressing the same color are connected in common to the first data line DL1.

Also, the green pixel cells G11 and G12 connected to the different gate lines GL and expressing the same color are connected in common to the second data line DL2, and the blue pixel cells B11 and B12 connected to the different gate lines GL and expressing the same color are connected in common to the third data line DL3.

This is also equally applied to the subsequently arranged pixel cells. That is, as stated above, in a pair of adjacent unit pixels, pixel cells of the same colors connected to different gate lines GL, among pixel cells of the three colors (R, G and B) constituting the respective unit pixels, are connected in common to the same data lines DL.

A frame inversion system, line inversion system, column inversion system, and dot inversion system are all applicable to the liquid crystal display device 300 according to the third embodiment of the present invention to drive the liquid crystal display device 300.

A detailed description will hereinafter be given of the application of the dot inversion system, among the above-stated driving systems, to the liquid crystal display device 300 according to the third embodiment of the present invention. In this dot inversion system, the polarities of video signals which are charged in the liquid crystal display panel 310 are inverted on a 1-dot or 2-dot basis in the horizontal direction and on a 1-dot basis in the vertical direction.

Figure 10:
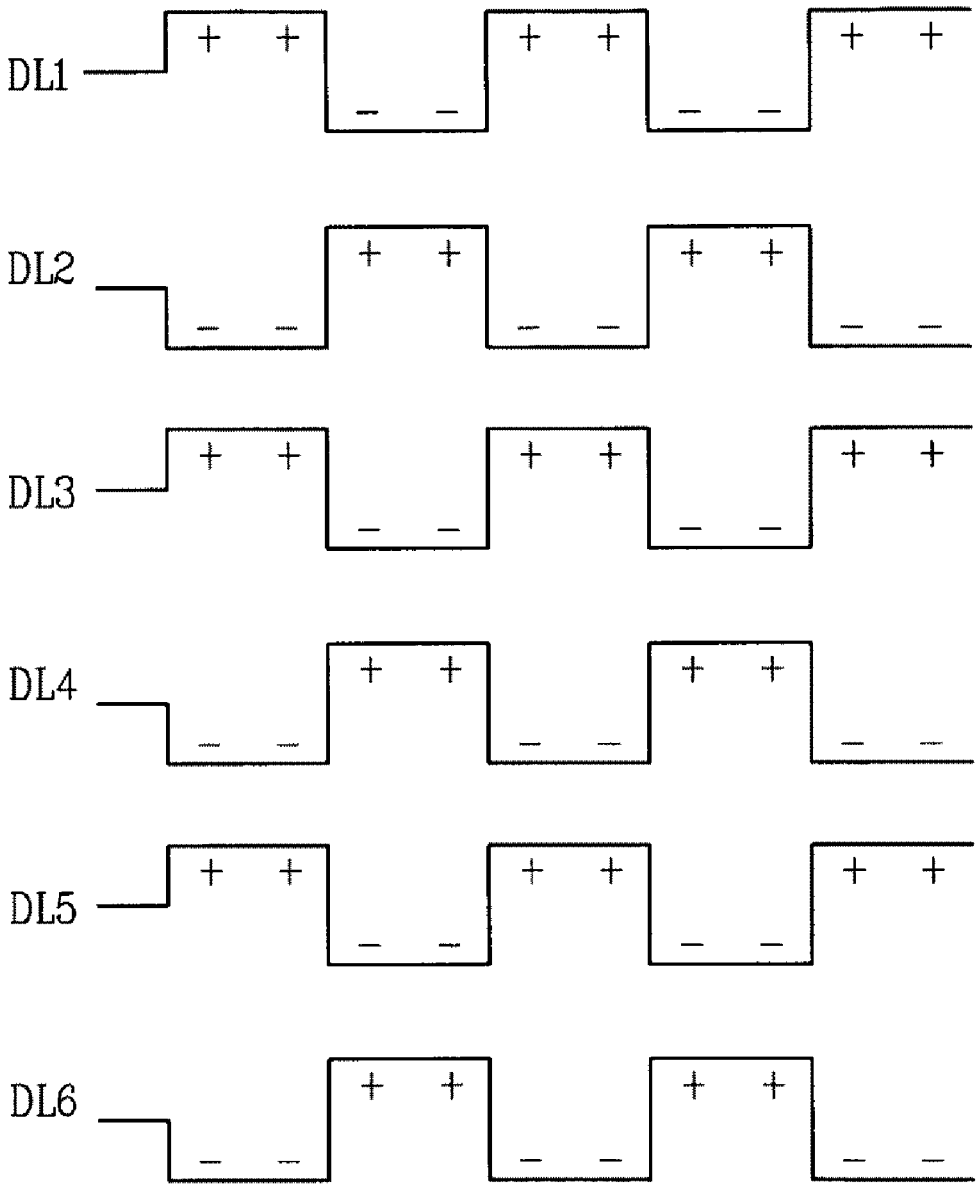
FIG. 10 is a waveform diagram of video data which is applied to data lines of the liquid crystal display device according to the third embodiment of the present invention.

FIG. 10 is a waveform diagram of video data which is applied to the data lines of the liquid crystal display device according to the third embodiment of the present invention, and FIG. 11 is a view showing polarity variations of video data which is charged in the liquid crystal display panel through the video data shown in FIG. 10.

A driving method of the liquid crystal display device according to the third embodiment of the present invention will hereinafter be described with reference to FIGS. 9 to 11.

In the liquid crystal display device 300 according to the third embodiment of the present invention, TFTs connected respectively to vertically arranged red (R), green (G) and blue (B) pixel cells are turned on sequentially in the vertical direction in one frame period. To this end, the gate drive signal (scan signal) is applied to the m gate lines GL1 to GLm sequentially from the first gate line GL1 to the mth gate line GLm.

If the first gate drive signal is applied to the first gate line GL1 during one frame period, TFTs of pixel cells R12, G12, B12, R14, G14, B14, . . . connected to the first gate line GL1 on the first horizontal line formed between the first gate line GL1 and the second gate line GL2 are turned on.

Thereafter, if the second gate drive signal is applied to the second gate line GL2, TFTs of pixel cells R11, G11, B11, R13, G13, B13, . . . connected to the second gate line GL2 are turned on. That is, the TFTs of the pixel cells other than the pixel cells previously turned on by the first gate drive signal inputted to the first gate line GL1, among the pixel cells on the first horizontal line formed between the first gate line GL1 and the second gate line GL2, are turned on.

Then, if the third gate drive signal is applied to the third gate line GL3, TFTs of pixel cells R21, G21, B21, R23, G23, B23, . . . connected to the third gate line GL3 on the second horizontal line formed between the third gate line GL3 and the fourth gate line GL4 are turned on.

Thereafter, if the fourth gate drive signal is applied to the fourth gate line GL4, TFTs of pixel cells R22, G22, B22, R24, G24, B24 . . . connected to the fourth gate line GL4 are turned on.

That is, the TFTs of the pixel cells other than the pixel cells previously turned on by the third gate drive signal inputted to the third gate line GL3, among the pixel cells on the second horizontal line formed between the third gate line GL3 and the fourth gate line GL4, are turned on.

Subsequently, if the fifth to mth gate drive signals are applied respectively to the fifth to mth gate lines GL5 to GLm, TFTs connected to each of those gate lines on a horizontal line formed between each pair of gate lines GL are turned on to drive the corresponding pixel cells, respectively, as stated above.

If the gate drive signal is sequentially applied to the first to mth gate lines, analog video data signals which are inverted in polarity on a 2-pixel basis as shown in FIG. 10 are applied to the respective data lines DL1 to DLn at intervals at which the gate drive signal is supplied.

If the analog video data signals as shown in FIG. 10 are applied to the data lines DL1 to DLn, video data signals which are inverted in polarity on a 1-dot or 2-dot basis in the horizontal direction and on a 1-dot basis in the vertical direction as shown in FIG. 11 are charged in the pixel cells of the liquid crystal display panel 310.

Figure 12:
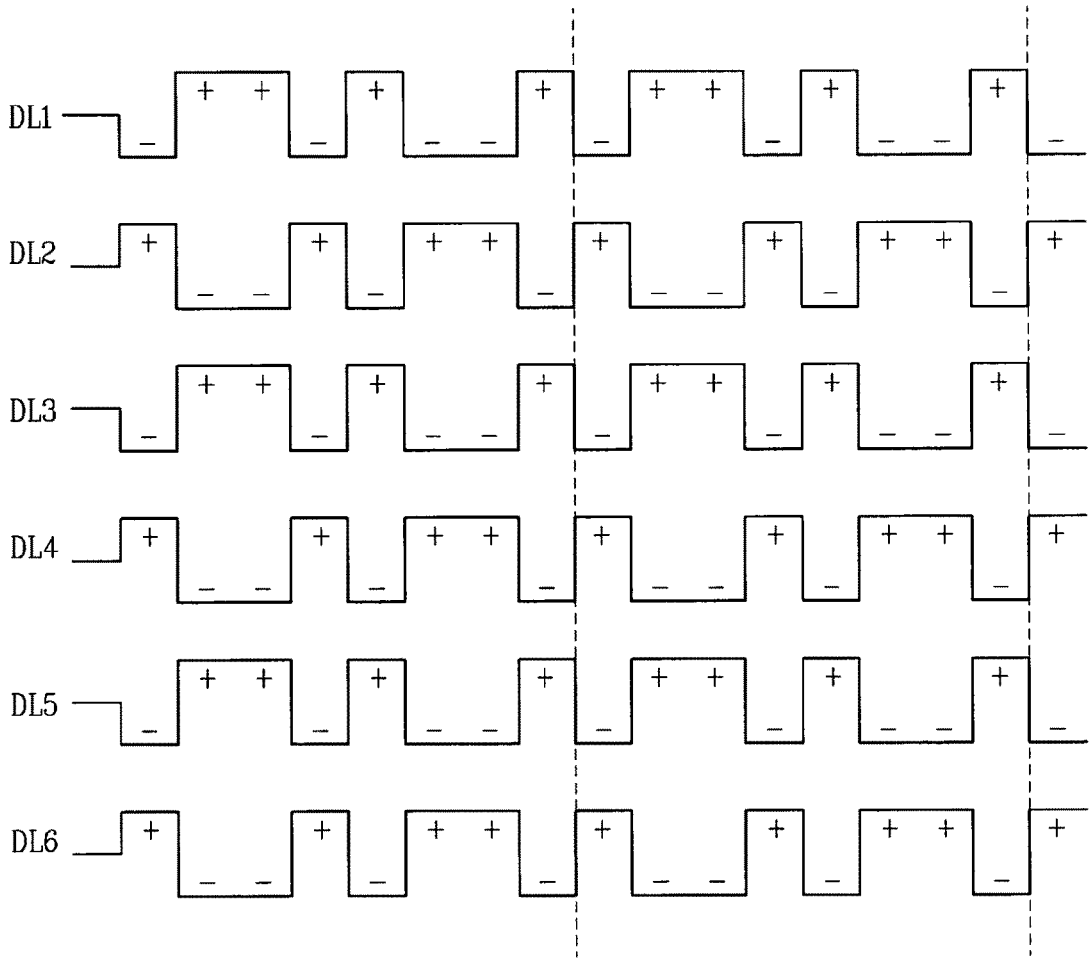
FIG. 12 is a waveform diagram of an alternative embodiment of the video data which is applied to the data lines of the liquid crystal display device according to the third embodiment of the present invention.

FIG. 12 is a waveform diagram of an alternative embodiment of the video data which is applied to the data lines of the liquid crystal display device according to the third embodiment of the present invention, and FIG. 13 is a view showing polarity variations of video data which is charged in a liquid crystal display panel through the video data shown in FIG. 12.

On the other hand, if analog video data signals which are symmetrical on an 8-pixel basis as shown in FIG. 12 are applied to the data lines DL1 to DLn of the liquid crystal display device 300 according to the third embodiment of the present invention, video data signals which are inverted in polarity on a 1-dot basis in the horizontal direction and on a 2-dot basis in the vertical direction as shown in FIG. 13 are charged in the pixel cells of the liquid crystal display panel 310.

When the super pixel gray pattern test is performed with respect to the liquid crystal display device according to the third embodiment of the present invention, all pixel cells are precharged by black video data, as shown in FIG. 5, so as to prevent the picture quality from being degraded due to a charging difference among the video data signals. As a result, it is possible to reduce the number of data drive ICs of the liquid crystal display device without degrading the display quality of the display device.

In the liquid crystal display device according to the third embodiment of the present invention, through the above-stated configuration, pixel cells expressing the same colors, among respective three-color pixel cells constituting a pair of adjacent unit pixels, are connected in common to the same data lines, thereby making it possible to reduce the number of costly data drive ICs to ½ that in the conventional liquid crystal display device shown in FIG. 1. Therefore, it is possible to reduce the manufacturing cost of the liquid crystal display device.

Figure 14:
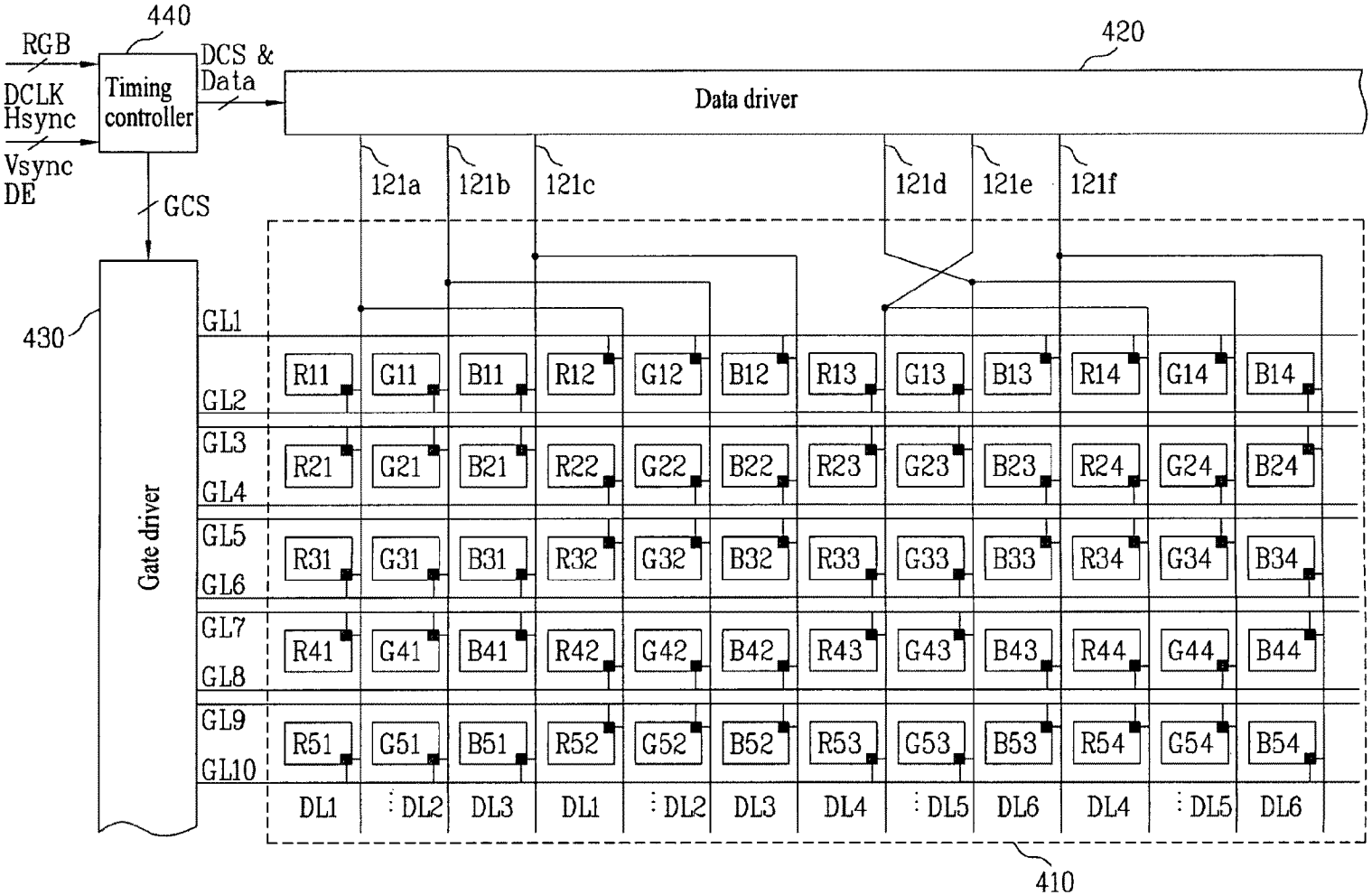
FIG. 14 is a view showing the configuration of a liquid crystal display device according to a fourth embodiment of the present invention.

FIG. 14 shows the configuration of a liquid crystal display device according to a fourth embodiment of the present invention.

The liquid crystal display device according to the fourth embodiment of the present invention, denoted by reference numeral 400, is the same in configuration as the liquid crystal display devices 100 to 300 according to the first to third embodiments of the present invention, with the exception of connections of gate lines GL, data lines DL and pixel cells in a liquid crystal display panel 410, and a detailed description of the same constituent elements will thus be omitted.

Referring to FIG. 14, the liquid crystal display device 400 according to the fourth embodiment of the present invention includes a liquid crystal display panel 410 including m gate lines GL1 to GLm formed in a horizontal direction, n data lines DL1 to DLn formed in a vertical direction and each connected in common to adjacent pixel cells expressing the same color, TFTs formed respectively in pixel areas defined by the m gate lines GL1 to GLm and the n data lines DL1 to DLn, and pixel cells connected respectively to the TFTs.

The liquid crystal display device 400 according to the fourth embodiment of the present invention further includes a gate driver 430 for sequentially supplying a gate drive signal to the gate lines GL1 to GLm, a data driver 420 for supplying video data R, G and B inputted thereto to the data lines DL1 to DLn synchronously with the gate drive signal, and a timing controller 440 for converting and arranging external video data R, G and B and supplying the resulting video data to the data driver 420, and controlling the driving of the gate driver 430 and data driver 420.

Here, the data lines DL1 to DL6 receive analog video data signals outputted from the data driver 420 over channels 121*a* to 121*f* corresponding respectively thereto.

The channels are the same in number as the data lines DL1 to DLn formed in the liquid crystal display panel 410. The (4*i*)th one of the channels is connected to the (4*i*+1)th data line, and the (4*i*+1)th channel is connected to the (4*i*)th data line.

For example, as shown in FIG. 14, the first one 121*a* of the n channels 121*a* to 121*n* is connected to the first data line DL1, the second channel 121*b* is connected to the second data line DL2, the third channel 121*c* is connected to the third data line DL3, and the sixth channel 121*f* is connected to the sixth data line DL6.

The channel 121*d* corresponding to the (4*i*)th channel, among the n channels 121*a* to 121*n*, is connected to the fifth data line DL5 corresponding to the (4*i*+1)th data line, and the channel 121*e* corresponding to the (4*i*+1)th channel is connected to the fourth data line DL4 corresponding to the (4*i*)th data line.

As stated above, the n data lines DL1 to DLn are connected to the channels 121*a* to 121*n* corresponding respectively thereto and receive the corresponding video data signals over the connected channels 121*a* to 121*n*, respectively.

In the liquid crystal display panel 410 of the liquid crystal display device 400 according to the fourth embodiment of the present invention, pixel cells "R11" to "B1*n*" are formed on a first horizontal line formed between the first gate line GL1 and the second gate line GL2, and pixel cells "R21" to "B2*n*" are formed on a second horizontal line formed between the third gate line GL3 and the fourth gate line GL4.

Then, pixel cells of three colors (R, G and B) are alternately formed on a horizontal line formed between each pair of gate lines GL, as stated above, up to the mth gate line GLm.

Adjacent pixel cells of the three colors (R, G and B) which are present on one horizontal line and are connected to the same gate line GL and turned on thereby, among these pixel cells, constitute one unit pixel.

Two adjacent unit pixels on one horizontal line, among these unit pixels, are connected to different gate lines GL.

In a pair of adjacent unit pixels connected to different gate lines GL, pixel cells expressing the same colors, among pixel cells of the three colors (R, G and B) constituting the respective unit pixels, are connected in common to the same data lines DL.

For example, among the pixel cells "R11" to "B1*n*" on the first horizontal line formed between the first gate line GL1 and the second gate line GL2, the red pixel cell "R14" connected to the first gate line GL1 and the red pixel cell "R13" connected to the second gate line GL2 are connected in common to the same fourth data line DL4.

That is, the red pixel cells "R14" and "R13" on the horizontal line, connected to the different gate lines GL and expressing the same color, are connected in common to the fourth data line DL4.

Also, the green pixel cells "G13" and "G14" connected to the different gate lines GL and expressing the same color are connected in common to the fifth data line DL5, and the blue pixel cells "B13" and "B14" connected to the different gate lines GL and expressing the same color are connected in common to the sixth data line DL6.

This is also equally applied to the subsequently arranged pixel cells. That is, as stated above, in a pair of adjacent unit pixels, pixel cells of the same colors connected to different gate lines GL, among pixel cells of the three colors (R, G and B) constituting the respective unit pixels, are connected in common to the same data lines DL.

A frame inversion system, line inversion system, column inversion system, and dot inversion system are all applicable to the liquid crystal display device 400 according to the fourth embodiment of the present invention to drive the liquid crystal display device 400.

A detailed description will hereinafter be given of the application of the dot inversion system, among the above-stated driving systems, to the liquid crystal display device 400 according to the fourth embodiment of the present invention. In this dot inversion system, the polarities of video signals which are charged in the liquid crystal display panel 410 are inverted on a 1-dot basis in the horizontal direction and on a 2-dot basis in the vertical direction.

Figure 15:
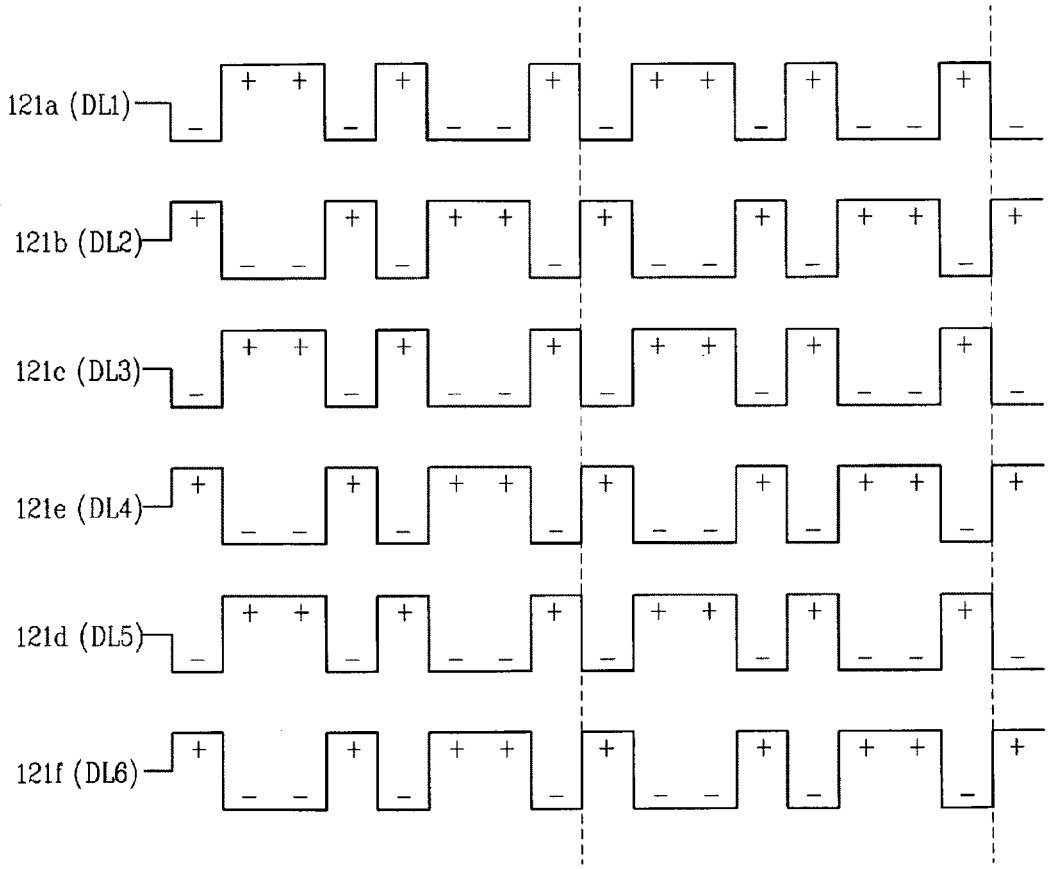
FIG. 15 is a waveform diagram of video data which is applied to data lines of the liquid crystal display device according to the fourth embodiment of the present invention.

FIG. 15 is a waveform diagram of video data which is applied to the data lines of the liquid crystal display device according to the fourth embodiment of the present invention, and FIG. 16 is a view showing polarity variations of video data which is charged in the liquid crystal display panel through the video data shown in FIG. 15.

A driving method of the liquid crystal display device according to the fourth embodiment of the present invention will hereinafter be described with reference to FIGS. 14 to 16.

In the liquid crystal display device 400 according to the fourth embodiment of the present invention, TFTs connected respectively to vertically arranged red (R), green (G) and blue (B) pixel cells are turned on sequentially in the vertical direction in one frame period. To this end, the gate drive signal (scan signal) is applied to the m gate lines GL1 to GLm sequentially from the first gate line GL1 to the mth gate line GLm.

If the first gate drive signal is applied to the first gate line GL1 during one frame period, TFTs of pixel cells R12, G12, B12, B13, R14, G14, . . . connected to the first gate line GL1 on the first horizontal line formed between the first gate line GL1 and the second gate line GL2 are turned on.

Thereafter, if the second gate drive signal is applied to the second gate line GL2, TFTs of pixel cells R11, G11, B11, R13, G13, B14, . . . connected to the second gate line GL2 are turned on.

That is, the TFTs of the pixel cells other than the pixel cells previously turned on by the first gate drive signal inputted to the first gate line GL1, among the pixel cells on the first horizontal line formed between the first gate line GL1 and the second gate line GL2, are turned on.

Subsequently, if the third gate drive signal is applied to the third gate line GL3, TFTs of pixel cells R21, G21, B21, R23, G23, B24, . . . connected to the third gate line GL3 on the second horizontal line formed between the third gate line GL3 and the fourth gate line GL4 are turned on.

Thereafter, if the fourth gate drive signal is applied to the fourth gate line GL4, TFTs of pixel cells R22, G22, B22, B23, R24, G24, . . . connected to the fourth gate line GL4 are turned on.

That is, the TFTs of the pixel cells other than the pixel cells previously turned on by the third gate drive signal inputted to the third gate line GL3, among the pixel cells on the second horizontal line formed between the third gate line GL3 and the fourth gate line GL4, are turned on.

Subsequently, if the fifth to mth gate drive signals are applied respectively to the fifth to mth gate lines GL5 to GLm, TFTs connected to each of those gate lines on a horizontal line formed between each pair of gate lines GL are turned on to drive the corresponding pixel cells, respectively, as stated above.

If the gate drive signal is sequentially applied to the first to mth gate lines, analog video data signals which are symmetrical on an 8-pixel basis as shown in FIG. 15 are applied to the respective data lines DL1 to DLn at intervals at which the gate drive signal is supplied.

If the analog video data signals as shown in FIG. 15 are applied to the data lines DL1 to DLn, video data signals which are inverted in polarity on a 1-dot basis in the horizontal direction and on a 2-dot basis in the vertical direction as shown in FIG. 16 are charged in the pixel cells of the liquid crystal display panel 410.

Figure 17:
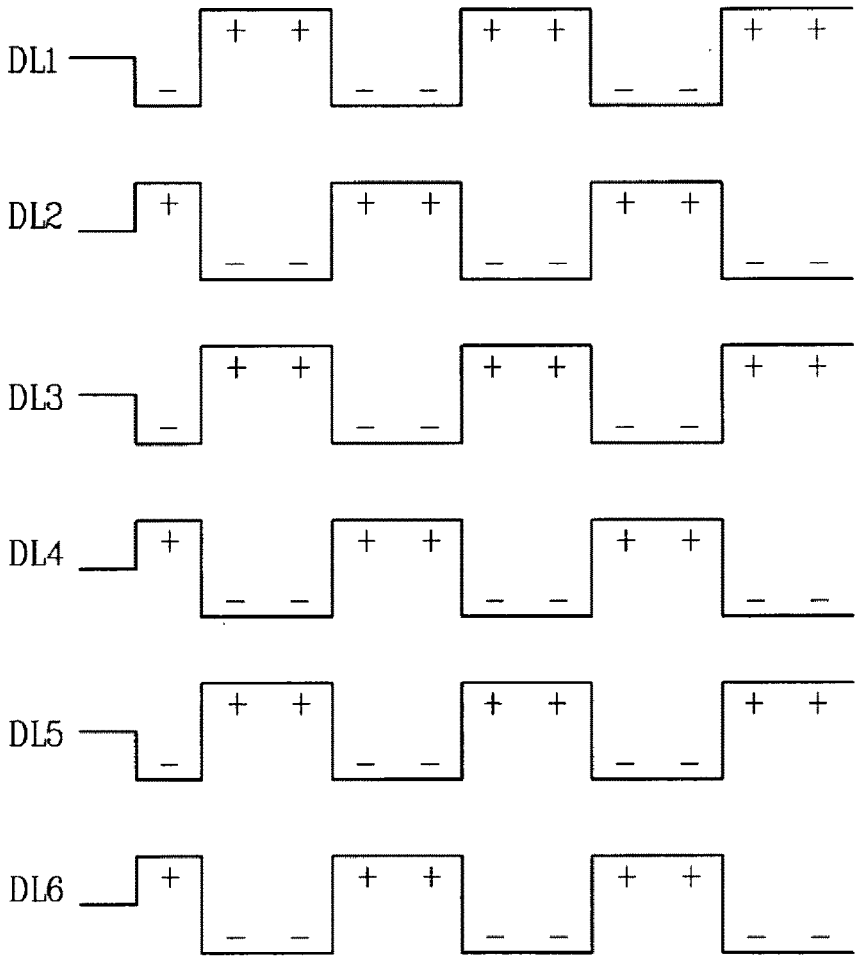
FIG. 17 is a waveform diagram of an alternative embodiment of the video data which is applied to the data lines of the liquid crystal display device according to the fourth embodiment of the present invention.

FIG. 17 is a waveform diagram of an alternative embodiment of the video data which is applied to the data lines of the liquid crystal display device according to the fourth embodiment of the present invention, and FIG. 18 is a view showing polarity variations of video data which is charged in a liquid crystal display panel through the video data shown in FIG. 17.

On the other hand, if analog video data signals which are inverted in polarity on a 2-pixel basis as shown in FIG. 17 are applied to the data lines DL1 to DLn of the liquid crystal display device 400 according to the fourth embodiment of the present invention, video data signals which are inverted in polarity on a 1-dot basis in the horizontal direction and are the same in polarity in the vertical direction as shown in FIG. 18 are charged in the pixel cells of the liquid crystal display panel 410.

When the super pixel gray pattern test is performed with respect to the liquid crystal display device according to the fourth embodiment of the present invention, all pixel cells are precharged by black video data, as shown in FIG. 5, so as to prevent the picture quality from being degraded due to a charging difference among the video data signals. As a result, it is possible to reduce the number of data drive ICs of the liquid crystal display device without degrading the display quality of the display device.

In the liquid crystal display device according to the fourth embodiment of the present invention, through the above-stated configuration, pixel cells expressing the same colors, among respective three-color pixel cells constituting a pair of adjacent unit pixels, are connected in common to the same data lines, thereby making it possible to reduce the number of costly data drive ICs to ½ that in the conventional liquid crystal display device shown in FIG. 1. Therefore, it is possible to reduce the manufacturing cost of the liquid crystal display device.

Figure 19:
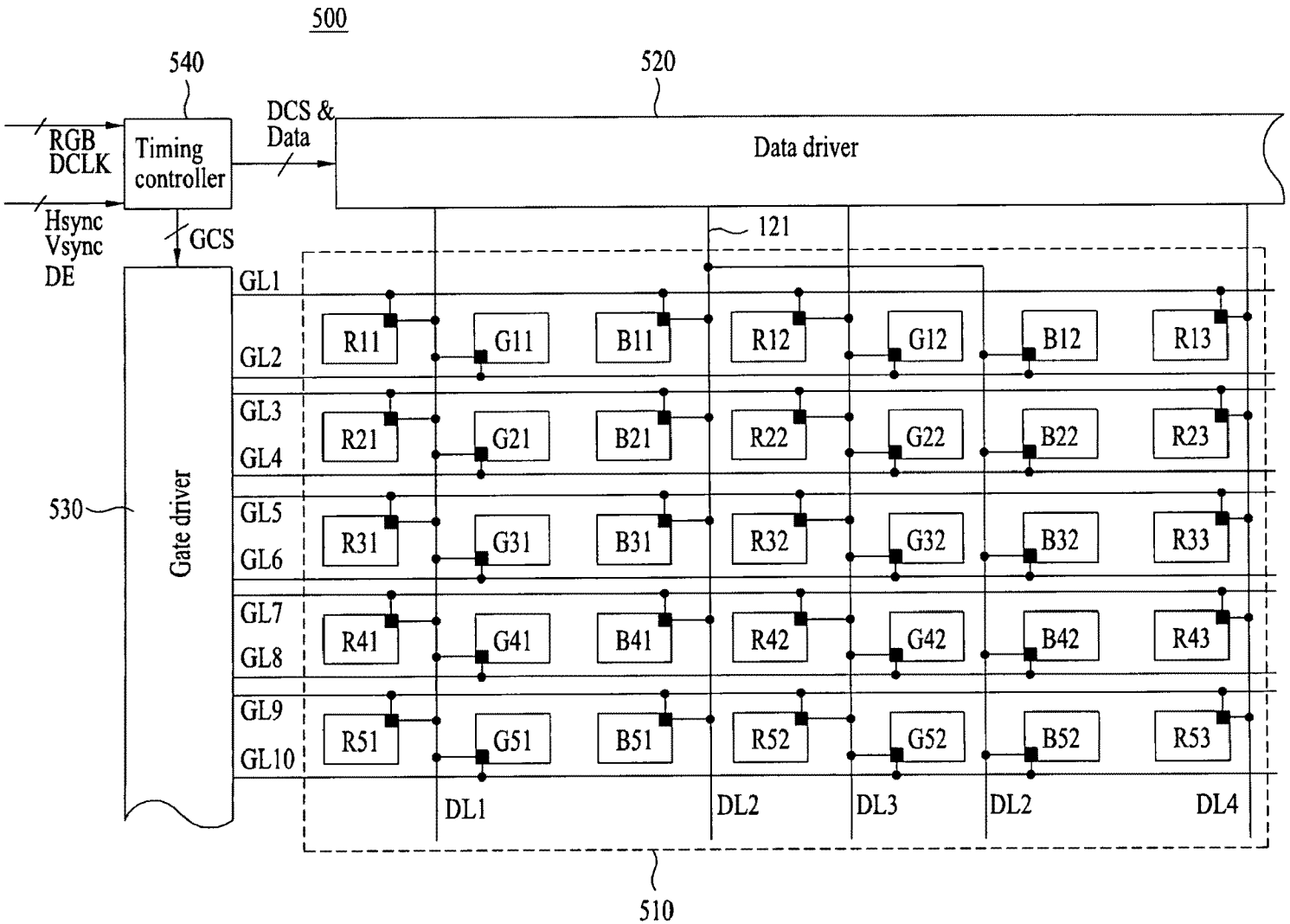
FIG. 19 is a view showing the configuration of a liquid crystal display device according to a fifth embodiment of the present invention.

FIG. 19 shows the configuration of a liquid crystal display device according to a fifth embodiment of the present invention.

The liquid crystal display device according to the fifth embodiment of the present invention, denoted by reference numeral 500, is the same in configuration as the liquid crystal display devices 100 to 400 according to the first to fourth embodiments of the present invention, with the exception of connections of gate lines GL, data lines DL and pixel cells in a liquid crystal display panel 510, and a detailed description of the same constituent elements will thus be omitted.

Referring to FIG. 19, the liquid crystal display device 500 according to the fifth embodiment of the present invention includes a liquid crystal display panel 510 including m gate lines GL1 to GLm formed in a horizontal direction, n data lines DL1 to DLn formed in a vertical direction and each connected in common to adjacent pixel cells expressing different colors on a horizontal line or adjacent pixel cells expressing the same color on the horizontal line, TFTs formed respectively in pixel areas defined by the m gate lines GL1 to GLm and the n data lines DL1 to DLn, and pixel cells connected respectively to the TFTs.

The liquid crystal display device 500 according to the fifth embodiment of the present invention further includes a gate driver 530 for sequentially supplying a gate drive signal to the gate lines GL1 to GLm, a data driver 520 for supplying video data R, G and B inputted thereto to the data lines DL1 to DLn synchronously with the gate drive signal, and a timing controller 540 for converting and arranging external video data R, G and B and supplying the resulting video data to the data driver 520, and controlling the driving of the gate driver 530 and data driver 520.

Here, the data lines DL1 to DLn receive analog video data signals outputted from the data driver 520 over channels 121 corresponding respectively thereto.

The liquid crystal display device 500 according to the fifth embodiment of the present invention is characterized by the configurations of the data lines DL1 to DLn which are each connected in common to adjacent pixel cells expressing different colors on a horizontal line or adjacent pixel cells expressing the same color on the horizontal line.

In more detail, as shown in FIG. 19, in the liquid crystal display panel 510, pixel cells of the same colors are arranged in the vertical direction and R, G and B pixel cells are alternately arranged in the horizontal direction.

A plurality of red pixel cells R11 to Rj1 arranged on a first vertical line and a plurality of green pixel cells G11 to Gk1 arranged on a second vertical line are connected in common to the first data line DL1. Namely, a plurality of adjacent pixel cells expressing different colors on one horizontal line are connected in common to one data line DL1.

Here, each of the red pixel cells R11 to Rj1 and each of the green pixel cells G11 to Gk1 are connected to different gate lines GL1 to GLm and driven thereby.

Although it is shown in FIG. 19 and has been previously described that the red pixel cells R11 to Rj1 are arranged on the first vertical line and the green pixel cells G11 to Gk1 are arranged on the second vertical line, it is merely one embodiment and the red pixel cells and the green pixel cells may be arranged to be transposed.

On the other hand, a plurality of blue pixel cells B11 to Bh1 arranged on a third vertical line and a plurality of blue pixel cells B12 to Bh2 arranged on a sixth vertical line are connected in common to the second data line DL2 which is connected to one channel 121 and branched off therefrom. That is, a plurality of adjacent pixel cells B11 to Bh1 and B12 to Bh2 expressing the same color are connected in common to the branched-off data line DL2.

As shown in FIG. 19, the adjacent pixel cells B11 to Bh1 and B12 to Bh2 expressing the same color are spaced apart from each other.

In the liquid crystal display device 500 according to the fifth embodiment of the present invention, a plurality of pixel cells spaced apart from each other and expressing the same color are connected in common to the data line DL2 connected to one channel 121 and branched off therefrom.

Here, each of the blue pixel cells B11 to Bh1 arranged on the third vertical line and each of the blue pixel cells B12 to Bh2 arranged on the sixth vertical line are connected to different gate lines GL1 to GLm and driven thereby.

Also, a plurality of red pixel cells R12 to Rj2 arranged on a fourth vertical line and a plurality of green pixel cells G12 to Gk2 arranged on a fifth vertical line are connected in common to the third data line DL3.

The red pixel cells R12 to Rj2 and green pixel cells G12 to Gk2 are the same in arrangement and configuration as the aforementioned red pixel cells and green pixel cells arranged on the first and second vertical lines, with the exception of the commonly connected data line.

This is also equally applied to the subsequently arranged pixel cells. That is, adjacent pixel cells expressing different colors on each horizontal line or adjacent pixel cells expressing the same color on each horizontal line are connected in common to one data line.

In the liquid crystal display device 500 according to the fifth embodiment of the present invention, as stated above, the arrangement of data lines connected in common to pixel cells expressing different colors and pixel cells expressing the same color is repeated, thereby making it possible to reduce the number of data drive ICs constituting the data driver 520 which applies video data to a plurality of R, G and B pixel cells in the liquid crystal display panel 510, to ½ that in the conventional liquid crystal display device.

The liquid crystal display device 500 according to the fifth embodiment of the present invention can reduce the number of costly data drive ICs to ½ that in the conventional liquid crystal display device, so as to curtail the manufacturing cost of the liquid crystal display device.

A frame inversion system, line inversion system, column inversion system, and dot inversion system are all applicable to the liquid crystal display device 500 according to the fifth embodiment of the present invention to drive the liquid crystal display device 500. A detailed description will hereinafter be given of the application of the dot inversion system to the liquid crystal display device 500 according to the fifth embodiment of the present invention for the purpose of preventing crosstalk and flickering. In this dot inversion system, the polarities of video signals which are charged in the liquid crystal display panel 510 are inverted on a 1-dot basis in the vertical and horizontal directions.

Figure 20:
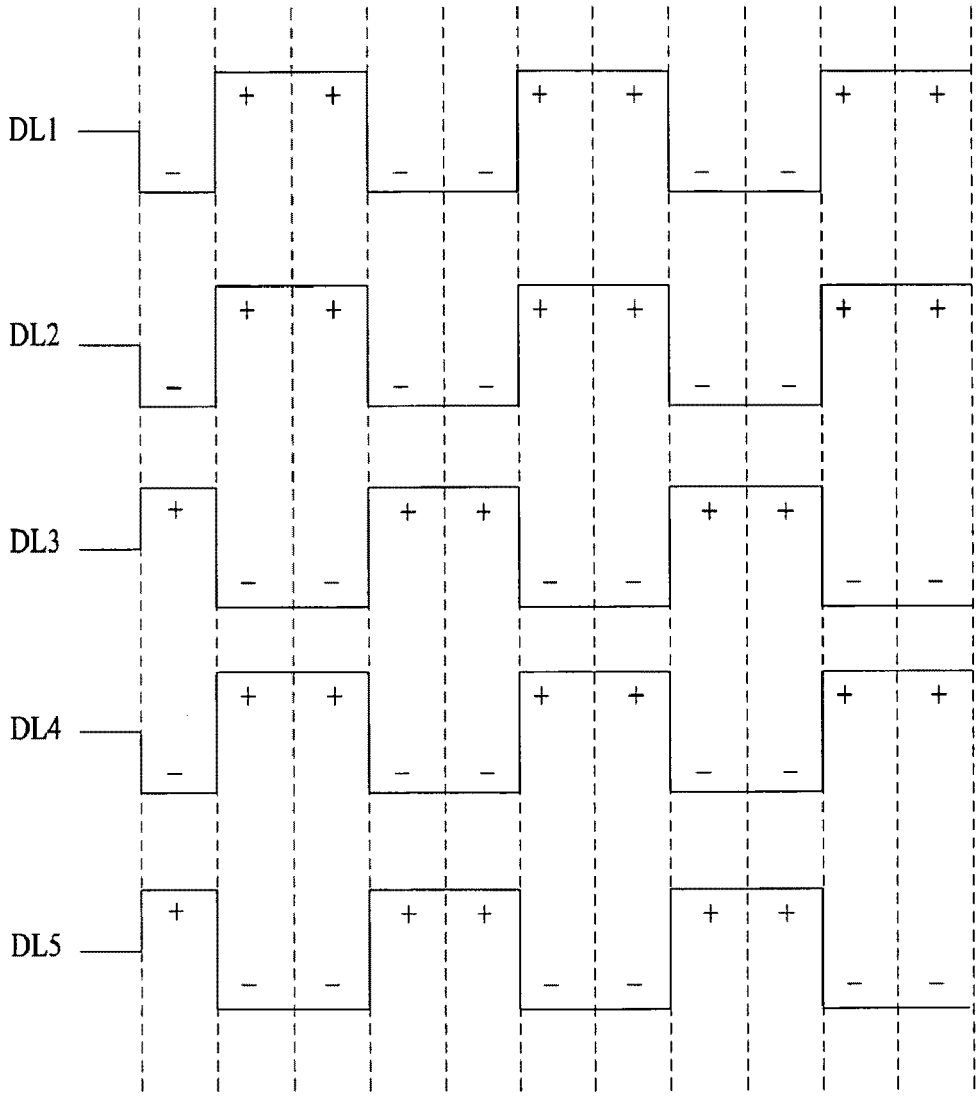
FIG. 20 is a waveform diagram of video data which is applied to data lines of the liquid crystal display device according to the fifth embodiment of the present invention.

FIG. 20 is a waveform diagram of video data which is applied to the data lines of the liquid crystal display device according to the fifth embodiment of the present invention, and FIG. 21 is a view showing polarity variations of video data which is charged in the liquid crystal display panel through the video data shown in FIG. 20.

A driving method of the liquid crystal display device according to the fifth embodiment of the present invention will hereinafter be described with reference to FIGS. 19 to 21.

In the liquid crystal display device 500 according to the fifth embodiment of the present invention, TFTs connected respectively to vertically arranged red (R), green (G) and blue (B) pixel cells are turned on sequentially in the vertical direction in one frame period. To this end, the gate drive signal (scan signal) is applied to the m gate lines GL1 to GLm sequentially from the first gate line GL1 to the mth gate line GLm.

If the first gate drive signal is applied to the first gate line GL1 during one frame period, TFTs of pixel cells R11, B11, R12, R13, . . . connected to the first gate line GL1 on the first horizontal line formed between the first gate line GL1 and the second gate line GL2 are turned on.

Thereafter, if the second gate drive signal is applied to the second gate line GL2, TFTs of pixel cells G11, G12, B12, . . . connected to the second gate line GL2 are turned on. That is, the TFTs of the pixel cells other than the pixel cells previously turned on by the first gate drive signal inputted to the first gate line GL1, among the pixel cells on the first horizontal line formed between the first gate line GL1 and the second gate line GL2, are turned on.

Subsequently, if the third gate drive signal is applied to the third gate line GL3, TFTs of pixel cells R21, B21, R22, R23, . . . connected to the third gate line GL3 on the second horizontal line formed between the third gate line GL3 and the fourth gate line GL4 are turned on.

Thereafter, if the fourth gate drive signal is applied to the fourth gate line GL4, TFTs of pixel cells G21, G22, B22, . . . connected to the fourth gate line GL4 are turned on. That is, the TFTs of the pixel cells other than the pixel cells previously turned on by the third gate drive signal inputted to the third gate line GL3, among the pixel cells on the second horizontal line formed between the third gate line GL3 and the fourth gate line GL4, are turned on.

Then, if the fifth to mth gate drive signals are applied respectively to the fifth to mth gate lines GL5 to GLm, TFTs connected to each of those gate lines on a horizontal line formed between each pair of gate lines GL are turned on to drive the corresponding pixel cells, respectively, as stated above.

If the gate drive signal is sequentially applied to the first to mth gate lines, analog video data signals which are symmetrical on a 2-pixel basis as shown in FIG. 20 are applied to the respective data lines DL1 to DLn at intervals at which the gate drive signal is supplied.

If the analog video data signals as shown in FIG. 20 are applied to the data lines DL1 to DLn, video data signals which are inverted in polarity on a 1-dot basis in the vertical and horizontal directions as shown in FIG. 21 are charged in the pixel cells of the liquid crystal display panel 510.

Although it has been described in conjunction with FIGS. 20 and 21 that the video data signals which are inverted in polarity on a 1-dot basis in the vertical and horizontal directions are charged in the pixel cells of the liquid crystal display panel 510, the liquid crystal display device may be driven by any inversion system other than the 1-dot inversion system, based on variations of video data which is applied to the data lines.

When the super pixel gray pattern test is performed with respect to the liquid crystal display device according to the fifth embodiment of the present invention, the picture quality can be prevented from being degraded due to a charging difference among the video data signals, as shown in FIG. 5. As a result, it is possible to reduce the number of data drive ICs of the liquid crystal display device without degrading the display quality of the display device, so as to curtail the manufacturing cost of the display device.

Figure 22:
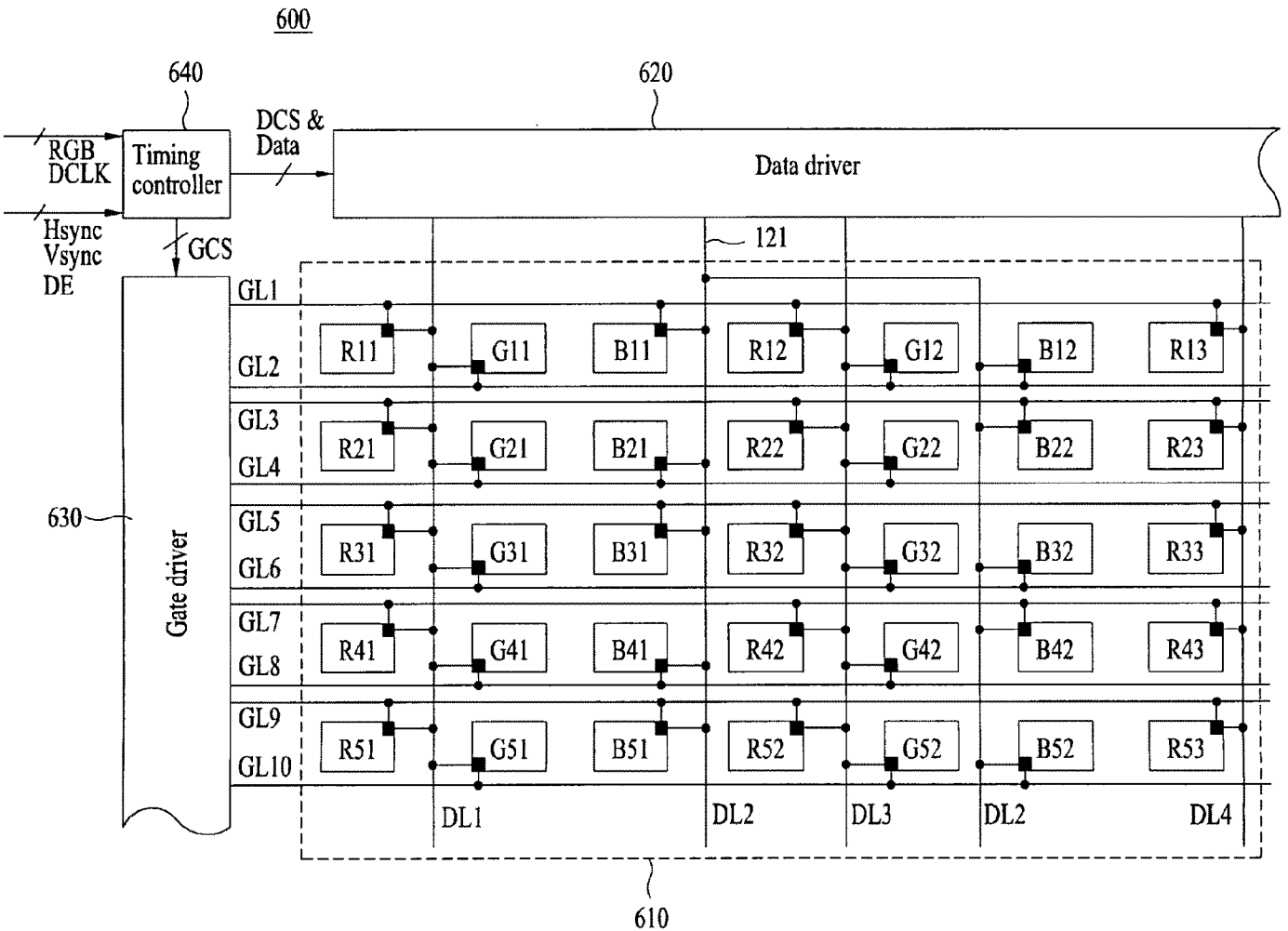
FIG. 22 is a view showing the configuration of a liquid crystal display device according to a sixth embodiment of the present invention.

FIG. 22 shows the configuration of a liquid crystal display device according to a sixth embodiment of the present invention.

The liquid crystal display device according to the sixth embodiment of the present invention, denoted by reference numeral 600, is the same in configuration as the liquid crystal display devices 100 to 500 according to the first to fifth embodiments of the present invention, with the exception that, in a liquid crystal display panel 610, a plurality of adjacent pixel cells expressing the same color on each horizontal line are connected in common to one data line, and with the exception of connections of gate lines, which supply a gate drive signal (scan signal) to drive the pixel cells, and the pixel cells in the liquid crystal display panel 610. Therefore, a detailed description of the same constituent elements will be omitted.

Referring to FIG. 22, the liquid crystal display device 600 according to the sixth embodiment of the present invention includes a liquid crystal display panel 610 including m gate lines GL1 to GLm formed in a horizontal direction, n data lines DL1 to DLn formed in a vertical direction and each connected in common to adjacent pixel cells expressing different colors on a horizontal line or adjacent pixel cells expressing the same color on the horizontal line, TFTs formed respectively in pixel areas defined by the m gate lines GL1 to GLm and the n data lines DL1 to DLn, and pixel cells connected respectively to the TFTs.

The liquid crystal display device 600 according to the sixth embodiment of the present invention further includes a gate driver 630 for sequentially supplying a gate drive signal to the gate lines GL1 to GLm, a data driver 620 for supplying video data R, G and B inputted thereto to the data lines DL1 to DLn synchronously with the gate drive signal, and a timing controller 640 for converting and arranging external video data R, G and B and supplying the resulting video data to the data driver 620, and controlling the driving of the gate driver 630 and data driver 620.

The liquid crystal display device 600 according to the sixth embodiment of the present invention is characterized by the configurations of the data lines DL1 to DLn which are each connected in common to adjacent pixel cells expressing different colors on a horizontal line or adjacent pixel cells expressing the same color on the horizontal line.

In more detail, as shown in FIG. 22, in the liquid crystal display panel 610, a plurality of pixel cells expressing the same colors are arranged in the vertical direction and R, G and B pixel cells are alternately arranged in the horizontal direction.

A plurality of blue pixel cells B11 to Bh1 arranged on a third vertical line and a plurality of blue pixel cells B12 to Bh2 arranged on a sixth vertical line are connected in common to the second data line DL2 which is connected to one channel 121 and branched off therefrom. That is, a plurality of adjacent pixel cells B11 to Bh1 and B12 to Bh2 expressing the same color on horizontal lines are connected in common to the branched-off data line DL2.

As shown in FIG. 22, the adjacent pixel cells B11 to Bh1 and B12 to Bh2 expressing the same color on the horizontal lines are spaced apart from each other.

In the liquid crystal display device 600 according to the sixth embodiment of the present invention, a plurality of pixel cells spaced apart from each other and expressing the same color are connected in common to the data line DL2 connected to one channel 121 and branched off therefrom.

Here, each of the blue pixel cells B11 to Bh1 arranged on the third vertical line and each of the blue pixel cells B12 to Bh2 arranged on the sixth vertical line are connected to different gate lines GL1 to GLm and driven thereby.

As stated previously with reference to FIG. 19, in the fifth embodiment of the present invention, the pixel cell "B21" expressing the blue color, arranged on the second horizontal line formed between the third gate line GL3 and the fourth gate line GL4, is connected to the third gate line GL3, and the pixel cell "B22" expressing the same color as that of the pixel cell "B21" is connected to the fourth gate line GL4.

In contrast, in the sixth embodiment of the present invention, the pixel cell "B21" expressing the blue color, arranged on the second horizontal line formed between the third gate line GL3 and the fourth gate line GL4, is connected to the fourth gate line GL4, and the pixel cell "B22" expressing the same color as that of the pixel cell "B21" is connected to the third gate line GL3.

Also, the pixel cell "B41" expressing the blue color, arranged on the fourth horizontal line formed between the seventh gate line GL7 and the eighth gate line GL8, is connected to the eighth gate line GL8, and the pixel cell "B42" expressing the same color as that of the pixel cell "B41" is connected to the seventh gate line GL7.

That is, the pixel cells expressing the blue color, arranged on the even horizontal lines (second, fourth, sixth, . . . ), are connected to the gate lines GL in a different manner from those in the liquid crystal display device 500 according to the fifth embodiment of the present invention, described previously.

This connection difference exhibits a difference in the driving order of the pixel cells connected to the first to mth gate lines GL1 to GLm when the gate drive signal is applied to the first to mth gate lines GL1 to GLm to drive the pixel cells.

The liquid crystal display device 600 according to the sixth embodiment of the present invention can offset a driving difference among the pixel cells which may occur when the gate drive signal is sequentially applied to the first to mth gate lines GL1 to GLm.

As stated above, the liquid crystal display device 600 according to the sixth embodiment of the present invention has a data line arrangement in which a plurality of pixel cells arranged on different vertical lines are connected in common.

This arrangement makes it possible to reduce the number of data drive ICs constituting the data driver 620 which applies video data to a plurality of R, G and B pixel cells in the liquid crystal display panel 610, to ½ that in the conventional liquid crystal display device.

The liquid crystal display device 600 according to the sixth embodiment of the present invention can reduce the number of costly data drive ICs to ½ that in the conventional liquid crystal display device, so as to curtail the manufacturing cost of the liquid crystal display device.

A frame inversion system, line inversion system, column inversion system, and dot inversion system are all applicable to the liquid crystal display device 600 according to the sixth embodiment of the present invention to drive the liquid crystal display device 600. A detailed description will hereinafter be given of the application of the dot inversion system to the liquid crystal display device 600 according to the sixth embodiment of the present invention. In this dot inversion system, the polarities of video signals which are charged in the liquid crystal display panel 610 are inverted on a 1-dot basis in the horizontal direction and on a 2-dot basis in the vertical direction.

Figure 23:
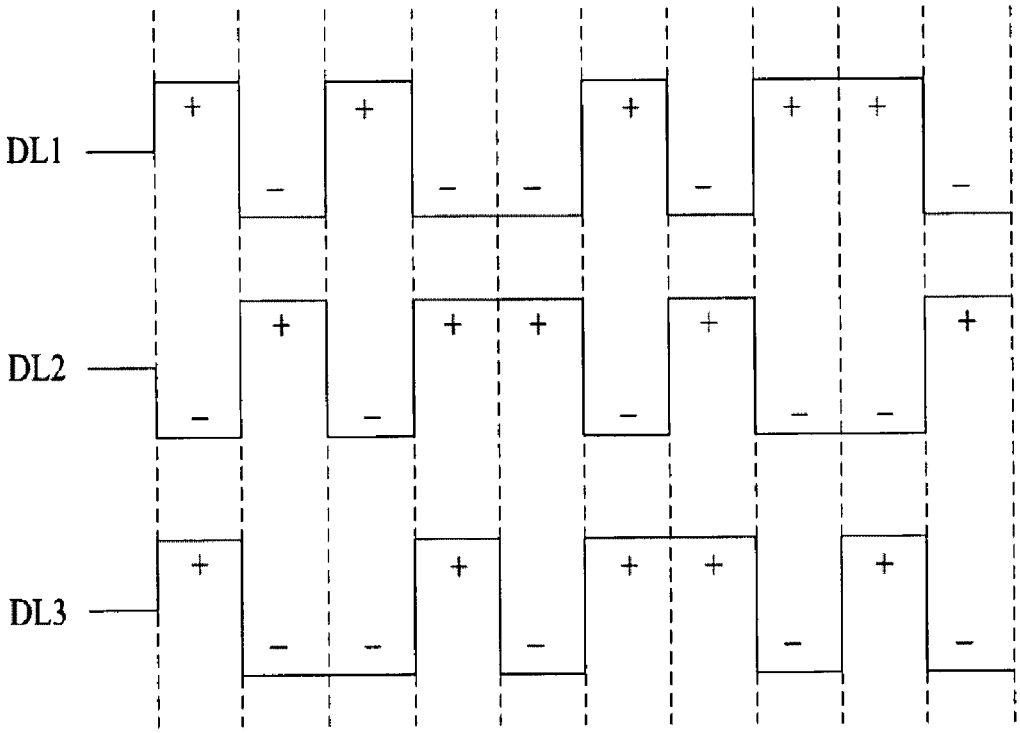
FIG. 23 is a waveform diagram of video data which is applied to data lines of the liquid crystal display device according to the sixth embodiment of the present invention.

FIG. 23 is a waveform diagram of video data which is applied to the data lines of the liquid crystal display device according to the sixth embodiment of the present invention, and FIG. 24 is a view showing polarity variations of video data which is charged in the liquid crystal display panel through the video data shown in FIG. 23.

A driving method of the liquid crystal display device according to the sixth embodiment of the present invention will hereinafter be described with reference to FIGS. 22 to 24.

In the liquid crystal display device 600 according to the sixth embodiment of the present invention, TFTs connected respectively to vertically arranged red (R), green (G) and blue (B) pixel cells are turned on sequentially in the vertical direction in one frame period. To this end, the gate drive signal (scan signal) is applied to the m gate lines GL1 to GLm sequentially from the first gate line GL1 to the mth gate line GLm.

If the first gate drive signal is applied to the first gate line GL1 during one frame period, TFTs of pixel cells R11, B11, R12, R13, . . . connected to the first gate line GL1 on the first horizontal line formed between the first gate line GL1 and the second gate line GL2 are turned on.

Thereafter, if the second gate drive signal is applied to the second gate line GL2, TFTs of pixel cells G11, G12, B12, . . . connected to the second gate line GL2 are turned on. That is, the TFTs of the pixel cells other than the pixel cells previously turned on by the first gate drive signal inputted to the first gate line GL1, among the pixel cells on the first horizontal line formed between the first gate line GL1 and the second gate line GL2, are turned on.

Subsequently, if the third gate drive signal is applied to the third gate line GL3, TFTs of pixel cells R21, R22, B22, R23, . . . connected to the third gate line GL3 on the second horizontal line formed between the third gate line GL3 and the fourth gate line GL4 are turned on.

Thereafter, if the fourth gate drive signal is applied to the fourth gate line GL4, TFTs of pixel cells G21, B21, G22, . . . connected to the fourth gate line GL4 are turned on.

That is, the TFTs of the pixel cells other than the pixel cells previously turned on by the third gate drive signal inputted to the third gate line GL3, among the pixel cells on the second horizontal line formed between the third gate line GL3 and the fourth gate line GL4, are turned on.

Subsequently, if the fifth to mth gate drive signals are applied respectively to the fifth to mth gate lines GL5 to GLm, TFTs connected to each of those gate lines on a horizontal line formed between each pair of gate lines GL are turned on to drive the corresponding pixel cells, respectively, as stated above.

If the gate drive signal is sequentially applied to the first to mth gate lines, analog video data signals as shown in FIG. 23 are applied to the respective data lines DL1 to DLn at intervals at which the gate drive signal is supplied.

If the analog video data signals as shown in FIG. 23 are applied to the data lines DL1 to DLn, video data signals which are inverted in polarity on a 1-dot basis in the horizontal direction and on a 2-dot basis in the vertical direction as shown in FIG. 24 are charged in the pixel cells of the liquid crystal display panel 610.

Although it has been described in conjunction with FIGS. 23 and 24 that the video data signals which are inverted in polarity on a 1-dot basis in the horizontal direction and on a 2-dot basis in the vertical direction are charged in the pixel cells of the liquid crystal display panel 610, the liquid crystal display device may be driven by any driving system other than the dot inversion system, based on variations of video data which is applied to the data lines.

When the super pixel gray pattern test is performed with respect to the liquid crystal display device according to the sixth embodiment of the present invention, the picture quality can be prevented from being degraded due to a charging difference among the video data signals, as shown in FIG. 5. Therefore, it is possible to reduce the number of data drive ICs of the liquid crystal display device without degrading the display quality of the display device, so as to curtail the manufacturing cost of the display device.

Figure 25:
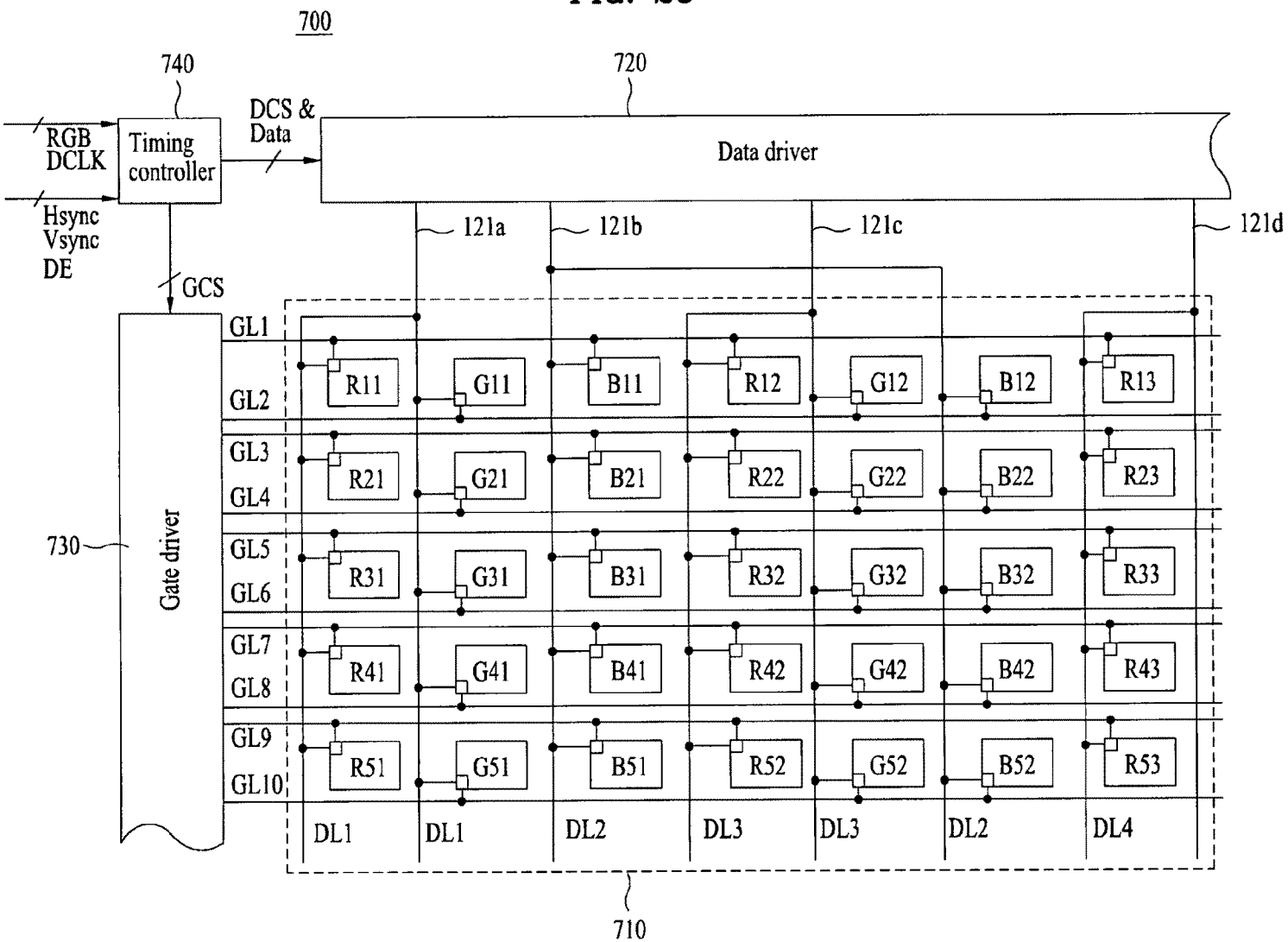
FIG. 25 is a view showing the configuration of a liquid crystal display device according to a seventh embodiment of the present invention.

FIG. 25 shows the configuration of a liquid crystal display device according to a seventh embodiment of the present invention.

The liquid crystal display device according to the seventh embodiment of the present invention, denoted by reference numeral 700, is the same in configuration as the liquid crystal display devices 100 to 600 according to the first to sixth embodiments of the present invention, with the exception of connections of gate lines GL, data lines DL and pixel cells in a liquid crystal display panel 710, and a detailed description of the same constituent elements will thus be omitted.

Referring to FIG. 25, the liquid crystal display device 700 according to the seventh embodiment of the present invention includes a liquid crystal display panel 710 including m gate lines GL1 to GLm formed in a horizontal direction, n data lines DL1 to DLn formed in a vertical direction and each connected in common to adjacent pixel cells expressing different colors on a horizontal line or adjacent pixel cells expressing the same color on the horizontal line, TFTs formed respectively in pixel areas defined by the m gate lines GL1 to GLm and the n data lines DL1 to DLn, and pixel cells connected respectively to the TFTs.

The liquid crystal display device 700 according to the seventh embodiment of the present invention further includes a gate driver 730 for sequentially supplying a gate drive signal to the gate lines GL1 to GLm, a data driver 720 for supplying video data R, G and B inputted thereto to the data lines DL1 to DLn synchronously with the gate drive signal, and a timing controller 740 for converting and arranging external video data R, G and B and supplying the resulting video data to the data driver 720, and controlling the driving of the gate driver 730 and data driver 720.

Here, the data lines DL1 to DLn receive analog video data signals outputted from the data driver 720 over channels 121*a* to 121*d* corresponding respectively thereto.

The liquid crystal display device 700 according to the seventh embodiment of the present invention is characterized by the configurations of the data lines DL1 to DLn which are each connected in common to adjacent pixel cells expressing different colors on a horizontal line or adjacent pixel cells expressing the same color on the horizontal line.

In more detail, as shown in FIG. 25, in the liquid crystal display panel 710, a plurality of pixel cells expressing the same colors are arranged in the vertical direction and R, G and B pixel cells are alternately arranged in the horizontal direction.

A plurality of red pixel cells R11 to Rj1 arranged on a first vertical line and a plurality of green pixel cells G11 to Gk1 arranged on a second vertical line are connected in common to the first data line DL1 which is connected to the first channel 121*a* and branched off therefrom. Namely, a plurality of adjacent pixel cells expressing different colors on one horizontal line are connected in common to the same data line DL1.

Here, each of the red pixel cells R11 to Rj1 and each of the green pixel cells G11 to Gk1 are connected to different gate lines GL1 to GLm and driven thereby.

Although it is shown in FIG. 25 and has been previously described that the red pixel cells R11 to Rj1 are arranged on the first vertical line and the green pixel cells G11 to Gk1 are arranged on the second vertical line, it is merely one embodiment and the red pixel cells and the green pixel cells may be arranged to be transposed.

On the other hand, a plurality of blue pixel cells B11 to Bh1 arranged on a third vertical line and a plurality of blue pixel cells B12 to Bh2 arranged on a sixth vertical line are connected in common to the second data line DL2 which is connected to the second channel 121*b* and branched off therefrom. That is, a plurality of adjacent pixel cells B11 to Bh1 and B12 to Bh2 expressing the same color on horizontal lines are connected in common to the same data line DL2.

As shown in FIG. 25, the adjacent pixel cells B11 to Bh1 and B12 to Bh2 expressing the same color on horizontal lines are spaced apart from each other.

In the liquid crystal display device 700 according to the seventh embodiment of the present invention, a plurality of pixel cells spaced apart from each other and expressing the same color are connected in common to the data line DL2 connected to the second channel 121*b* and branched off therefrom.

Here, each of the blue pixel cells B11 to Bh1 arranged on the third vertical line and each of the blue pixel cells B12 to Bh2 arranged on the sixth vertical line are connected to different gate lines GL1 to GLm and driven thereby.

Also, a plurality of red pixel cells R12 to Rj2 arranged on a fourth vertical line and a plurality of green pixel cells G12 to Gk2 arranged on a fifth vertical line are connected in common to the third data line DL3 which is connected to the third channel 121*c* and branched off therefrom.

The red pixel cells R12 to Rj2 and green pixel cells G12 to Gk2 are the same in arrangement and configuration as the aforementioned red pixel cells and green pixel cells arranged on the first and second vertical lines, with the exception of the commonly connected data line.

This is also equally applied to the subsequently arranged pixel cells. That is, adjacent pixel cells expressing different colors on each horizontal line or adjacent pixel cells expressing the same color on each horizontal line are connected in common to one data line.

In the liquid crystal display device 700 according to the seventh embodiment of the present invention, as stated above, the arrangement of data lines connected in common to pixel cells expressing different colors and pixel cells expressing the same color is repeated, thereby making it possible to reduce the number of data drive ICs constituting the data driver 720 which applies video data to a plurality of R, G and B pixel cells in the liquid crystal display panel 710, to ½ that in the conventional liquid crystal display device.

The liquid crystal display device 700 according to the seventh embodiment of the present invention can reduce the number of costly data drive ICs to ½ that in the conventional liquid crystal display device, so as to curtail the manufacturing cost of the liquid crystal display device.

Further, the liquid crystal display device 700 according to the seventh embodiment of the present invention can reduce a load of video data to be applied to the data lines by branching off each data line and connecting it to a plurality of pixel cells. In addition, the liquid crystal display device 700 can offset a driving difference among the pixel cells which may occur when the gate drive signal is sequentially or non-sequentially applied to the first to mth gate lines GL1 to GLm.

A frame inversion system, line inversion system, column inversion system, and dot inversion system are all applicable to the liquid crystal display device 700 according to the seventh embodiment of the present invention to drive the liquid crystal display device 700. A detailed description will hereinafter be given of the application of the dot inversion system to the liquid crystal display device 700 according to the seventh embodiment of the present invention. In this dot inversion system, the polarities of video signals which are charged in the liquid crystal display panel 710 are inverted on a 1-dot basis in the vertical direction and on a 2-dot basis in the horizontal direction.

Figure 26:
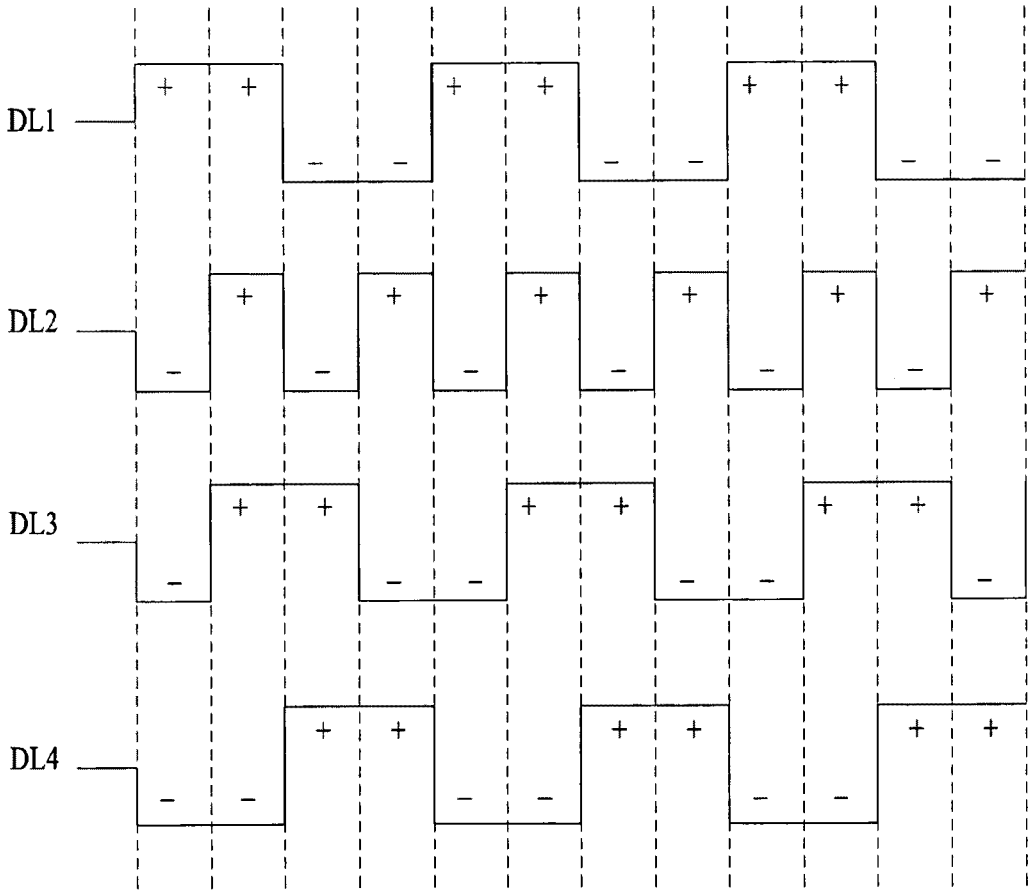
FIG. 26 is a waveform diagram of video data which is applied to data lines of the liquid crystal display device according to the seventh embodiment of the present invention.

FIG. 26 is a waveform diagram of video data which is applied to the data lines of the liquid crystal display device according to the seventh embodiment of the present invention, and FIG. 27 is a view showing polarity variations of video data which is charged in the liquid crystal display panel through the video data shown in FIG. 26.

A driving method of the liquid crystal display device according to the seventh embodiment of the present invention will hereinafter be described with reference to FIGS. 25 to 27.

In the liquid crystal display device 700 according to the seventh embodiment of the present invention, TFTs connected respectively to vertically arranged red (R), green (G) and blue (B) pixel cells are turned on sequentially in the vertical direction in one frame period. To this end, the gate drive signal (scan signal) is applied to the m gate lines GL1 to GLm sequentially from the first gate line GL1 to the mth gate line GLm.

If the first gate drive signal is applied to the first gate line GL1 during one frame period, TFTs of pixel cells R11, B11, R12, R13, . . . connected to the first gate line GL1 on the first horizontal line formed between the first gate line GL1 and the second gate line GL2 are turned on.

Thereafter, if the second gate drive signal is applied to the second gate line GL2, TFTs of pixel cells G11, G12, B12, . . . connected to the second gate line GL2 are turned on. That is, the TFTs of the pixel cells other than the pixel cells previously turned on by the first gate drive signal inputted to the first gate line GL1, among the pixel cells on the first horizontal line formed between the first gate line GL1 and the second gate line GL2, are turned on.

Subsequently, if the third gate drive signal is applied to the third gate line GL3, TFTs of pixel cells R21, B21, R22, R23, . . . connected to the third gate line GL3 on the second horizontal line formed between the third gate line GL3 and the fourth gate line GL4 are turned on.

Thereafter, if the fourth gate drive signal is applied to the fourth gate line GL4, TFTs of pixel cells G21, G22, B22, . . . connected to the fourth gate line GL4 are turned on. That is, the TFTs of the pixel cells other than the pixel cells previously turned on by the third gate drive signal inputted to the third gate line GL3, among the pixel cells on the second horizontal line formed between the third gate line GL3 and the fourth gate line GL4, are turned on.

Subsequently, if the fifth to mth gate drive signals are applied respectively to the fifth to mth gate lines GL5 to GLm, TFTs connected to each of those gate lines on a horizontal line formed between each pair of gate lines GL are turned on to drive the corresponding pixel cells, respectively, as stated above.

If the gate drive signal is sequentially applied to the first to mth gate lines, analog video data signals as shown in FIG. 26 are applied to the respective data lines DL1 to DLn at intervals at which the gate drive signal is supplied.

If the analog video data signals as shown in FIG. 26 are applied to the data lines DL1 to DLn, video data signals which are inverted in polarity on a 1-dot basis in the vertical direction and on a 2-dot basis in the horizontal direction as shown in FIG. 27 are charged in the pixel cells of the liquid crystal display panel 710.

Although it has been described in conjunction with FIGS. 26 and 27 that the video data signals which are inverted in polarity on a 1-dot basis in the vertical direction and on a 2-dot basis in the horizontal direction are charged in the pixel cells of the liquid crystal display panel 710, the liquid crystal display device may be driven by any inversion system other than this inversion system, based on variations of video data which is applied to the data lines.

When the super pixel gray pattern test is performed with respect to the liquid crystal display device according to the seventh embodiment of the present invention, the picture quality can be prevented from being degraded due to a charging difference among the video data signals, as shown in FIG. 5. As a result, it is possible to reduce the number of data drive ICs of the liquid crystal display device without degrading the display quality of the display device, so as to curtail the manufacturing cost of the display device.

As apparent from the above description, in a liquid crystal display device according to the present invention, pixel cells expressing the same colors, among respective three-color pixel cells constituting a pair of adjacent unit pixels, are connected in common to the same data lines, thereby making it possible to reduce the number of costly data drive ICs to ½ that in a conventional liquid crystal display device. Therefore, it is possible to reduce the manufacturing cost of the liquid crystal display device.

Further, a plurality of horizontally adjacent pixel cells expressing the same color or a plurality of pixel cells expressing different colors are connected in common to one data line, thereby making it possible to reduce the number of costly data drive ICs to ½ that in a conventional liquid crystal display device. Therefore, it is possible to reduce the manufacturing cost of the liquid crystal display device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device comprising:

a gate driver for sequentially supplying a drive signal to a plurality of gate lines;

a data driver for supplying video data signals respectively to a plurality of data lines; and a plurality of pixel cells formed respectively in areas defined by the gate lines and the data lines, wherein a plurality of adjacent pixel cells are connected in common to the same data lines, wherein the plurality of adjacent pixels connected in common to the same data lines are expressing the same colors or different colors on the horizontal lines, among the pixel cells.

2. The liquid crystal display device according to claim 1, wherein the data lines to which the adjacent pixel cells expressing the same colors on the horizontal lines are connected in common are branched off from channels connected to the data driver.

3. The liquid crystal display device according to claim 1, wherein the data lines to which the adjacent pixel cells expressing the different colors on the horizontal lines are connected in common are branched off from channels connected to the data driver.

4. The liquid crystal display device according to claim 2 or 3, wherein the channels are the same in number as the data lines to which the adjacent pixel cells expressing the same colors on the horizontal lines are connected in common.

5. The liquid crystal display device according to claim 2 or 3, wherein the channels are the same in number as the data lines to which the adjacent pixel cells expressing the different colors on the horizontal lines are connected in common.

* * * * *